US008584804B2

(12) United States Patent
Holland

(10) Patent No.: US 8,584,804 B2
(45) Date of Patent: Nov. 19, 2013

(54) APPARATUS FOR APPLYING A PUMPABLE MATERIAL TO A RAIL HEAD

(75) Inventor: Christopher D. Holland, Wood River, IL (US)

(73) Assignee: Lincoln Industrial Corporation, St. Louis, MO (US)

( * ) Notice: Subject to any disclaimer, the term of this patent is extended or adjusted under 35 U.S.C. 154(b) by 997 days.

(21) Appl. No.: 12/141,452

(22) Filed: Jun. 18, 2008

(65) Prior Publication Data

US 2009/0000870 A1 Jan. 1, 2009

Related U.S. Application Data

(63) Continuation-in-part of application No. 11/769,057, filed on Jun. 27, 2007.

(51) Int. Cl.
*B61K 3/00* (2006.01)

(52) U.S. Cl.
USPC ..... 184/3.1; 184/6.1; 184/27.1; 184/99; 104/279

(58) Field of Classification Search
USPC ..... 184/3.1, 3.2; 417/12
IPC ..... B61K 3/00
See application file for complete search history.

(56) References Cited

U.S. PATENT DOCUMENTS

| | | | | |
|---|---|---|---|---|
| 1,880,672 A | | 10/1932 | Bates | |
| 1,883,148 A | | 10/1932 | Warr | |
| 1,899,767 A | * | 2/1933 | Merk | 184/3.1 |
| 1,905,155 A | * | 4/1933 | Coors | 184/3.1 |
| 1,923,449 A | * | 8/1933 | Merk | 184/3.1 |

(Continued)

FOREIGN PATENT DOCUMENTS

| | | |
|---|---|---|
| DE | 921946 | 1/1955 |
| FR | 1333636 | 6/1963 |
| GB | 2267937 | 12/1993 |
| WO | 0061418 | 10/2000 |

OTHER PUBLICATIONS

Office action dated Jun. 26, 2009 regarding U.S. Appl. No. 11/769,057, 26 pages.

Portec Rail Products, Inc. 2007 Greaseguide, 2 pages.

(Continued)

*Primary Examiner* — Robert A Siconolfi
*Assistant Examiner* — San Aung
(74) *Attorney, Agent, or Firm* — Senniger Powers LLP

(57) ABSTRACT

An applicator assembly for delivery of a pumpable material to a top surface of a rail head of rail includes an applicator body having an orifice for delivery of the pumpable material to the top surface of the rail. The body is resiliently yieldable to permit the applicator body to move from a raised position, in which the orifice is positioned for delivering the pumpable material to the top surface of the rail head, to a depressed position in the event the applicator is contacted by a train wheel. The applicator body thereafter returns to the raised position. The applicator body is mounted for movement between a working position in which the applicator body is closely adjacent the rail head and a rail-service position in which the applicator body is remote from the rail head. When the applicator body is in its working position, a metal portion of the applicator body contacts the rail head to form a metal-on-metal hard seal extending lengthwise of the rail head for inhibiting leakage of the pumpable material from the top of the rail head. The applicator assembly is free of any non-metal seals for sealing against such leakage.

26 Claims, 18 Drawing Sheets

(56) References Cited

U.S. PATENT DOCUMENTS

| | | | | | |
|---|---|---|---|---|---|
| 1,936,481 | A | * | 11/1933 | Miller | 184/3.1 |
| 1,940,527 | A | | 12/1933 | Bolt | |
| 2,059,235 | A | | 11/1936 | Heidenthal | |
| 2,152,696 | A | | 4/1939 | Huck | |
| 2,168,554 | A | | 8/1939 | Bates | |
| 2,170,917 | A | | 8/1939 | Stern | |
| 2,185,810 | A | | 1/1940 | Heidenthal | |
| 2,223,714 | A | | 12/1940 | Bates | |
| 2,272,774 | A | | 2/1942 | McGarry | |
| 2,489,182 | A | | 11/1949 | Huck | |
| 2,718,280 | A | | 9/1955 | Hurrell | |
| 3,059,724 | A | | 10/1962 | Soule, Jr. | |
| 3,147,822 | A | | 9/1964 | Watts | |
| 4,088,078 | A | | 5/1978 | Noble | |
| 4,186,821 | A | | 2/1980 | Wegmann | |
| 4,214,647 | A | | 7/1980 | Lutts | |
| 4,556,127 | A | | 12/1985 | Doorley | |
| 4,811,818 | A | | 3/1989 | Jamison | |
| 5,054,582 | A | | 10/1991 | Aracil | |
| 5,076,396 | A | | 12/1991 | Foote | |
| 5,348,120 | A | | 9/1994 | Junk | |
| 5,394,958 | A | | 3/1995 | Junk | |
| 5,497,852 | A | | 3/1996 | Little | |
| 5,518,085 | A | * | 5/1996 | Houser et al. | 184/3.1 |
| 5,641,037 | A | | 6/1997 | Wise | |
| 5,687,814 | A | | 11/1997 | Craig | |
| 6,719,095 | B2 | | 4/2004 | Arens | |
| 6,742,624 | B2 | * | 6/2004 | DiCarlo | 184/3.1 |
| 6,971,479 | B1 | | 12/2005 | Urmson, Jr. | |
| 2004/0050623 | A1 | | 3/2004 | Urmson, Jr. | |

OTHER PUBLICATIONS

Richard P. Reiff and Scott Gage; "Lubrication: How much is enough?"; Railway Age; May 1999; pp. 59-60.

Portec Rail Products, Inc., Product Flyer: "Trackside Lubricant Applicators," Jan. 1998.

Portec Rail Products, Inc., Product Flyer: "Hydraulic Way-side Lubrication System"; Jan. 1998.

Portec Rail Products, Inc., Product Flyer: "Protector (R) II Electronic Rail Lubricator," Sep. 1993.

Portec Rail Products, Inc., Product Flyer: "MC(R) Series Mechanical Wayside Lubrication System," Jan. 1998.

R.P. Reiff; "Acceptance Tests for AAR Lubrication Research Vehicle", Lubrication Engineering; Apr. 1987, vol. 43, pp. 266-272.

KLS Lubriquip, Inc., IDEX Corporation: "Trackmaster Rte 25 Rail Flange Lubricator" Jan. 1996.

Manual: Section III—"Rail Wear & Lubrication," Undated but Admitted Prior Art; pp. 29-36.

Office action dated Dec. 30, 2009 regarding U.S. Appl. No. 11/769,057, 23 pages.

* cited by examiner

APPARATUS FOR APPLYING A PUMPABLE MATERIAL TO A RAIL HEAD

CROSS REFERENCE TO RELATED APPLICATION

This is a continuation-in-part of co-assigned U.S. patent application Ser. No. 11/769,057, filed Jun. 27, 2007.

FIELD OF THE INVENTION

This invention relates to an apparatus for applying pumpable material to a rail head of a rail, and more particularly to an apparatus for applying a friction modifying material to a rail head of a railroad rail.

BACKGROUND OF THE INVENTION

It is common practice to apply lubricants (e.g., grease) and other friction modifying materials onto railroad rails, such as to the tops or sides of the rails at or near curves, turnouts, switches and other locations where such materials are needed or desired. As applied to the rails, such materials either reduce or increase the friction where necessary to improve train performance and reduce wear on both the rails and the train wheels.

In the case of a friction modifying material that controls the friction between the train wheel and the rail, the conventional practice is to apply the material to the top of the rail to contact the train wheels. However, such prior art devices have been less than satisfactory for any number of reasons.

It is an objective of this invention, therefore, to provide an improved apparatus for delivering such material to a rail head.

SUMMARY OF THE INVENTION

This invention is directed to apparatus for delivering a pumpable material to a top surface of a rail head of a metal rail. The apparatus comprises an applicator assembly and a securing device for securing the applicator assembly to said rail. The applicator assembly comprises an applicator body having a plurality of orifices for delivery of said pumpable material to the top surface of the rail head. The body is resiliently yieldable to permit the applicator body to move from a raised position, in which the orifice are positioned for delivering said pumpable material to the top surface of the rail head, to a depressed position in the event the applicator is contacted by a train wheel, the applicator body thereafter being adapted to return to its raised position. The applicator assembly further comprises a mount mounting the applicator body for movement between a working position in which the applicator body is closely adjacent the rail head and a rail-service position in which the applicator body is remote from the rail head. The applicator assembly and securing device are configured such that when the applicator body is in its working position, a metal portion of the body contacts the rail head to form a metal-on-metal hard seal extending lengthwise of the rail head for inhibiting leakage of said pumpable material from the top of the rail head. The applicator assembly is free of any non-metal seals for sealing against said leakage.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
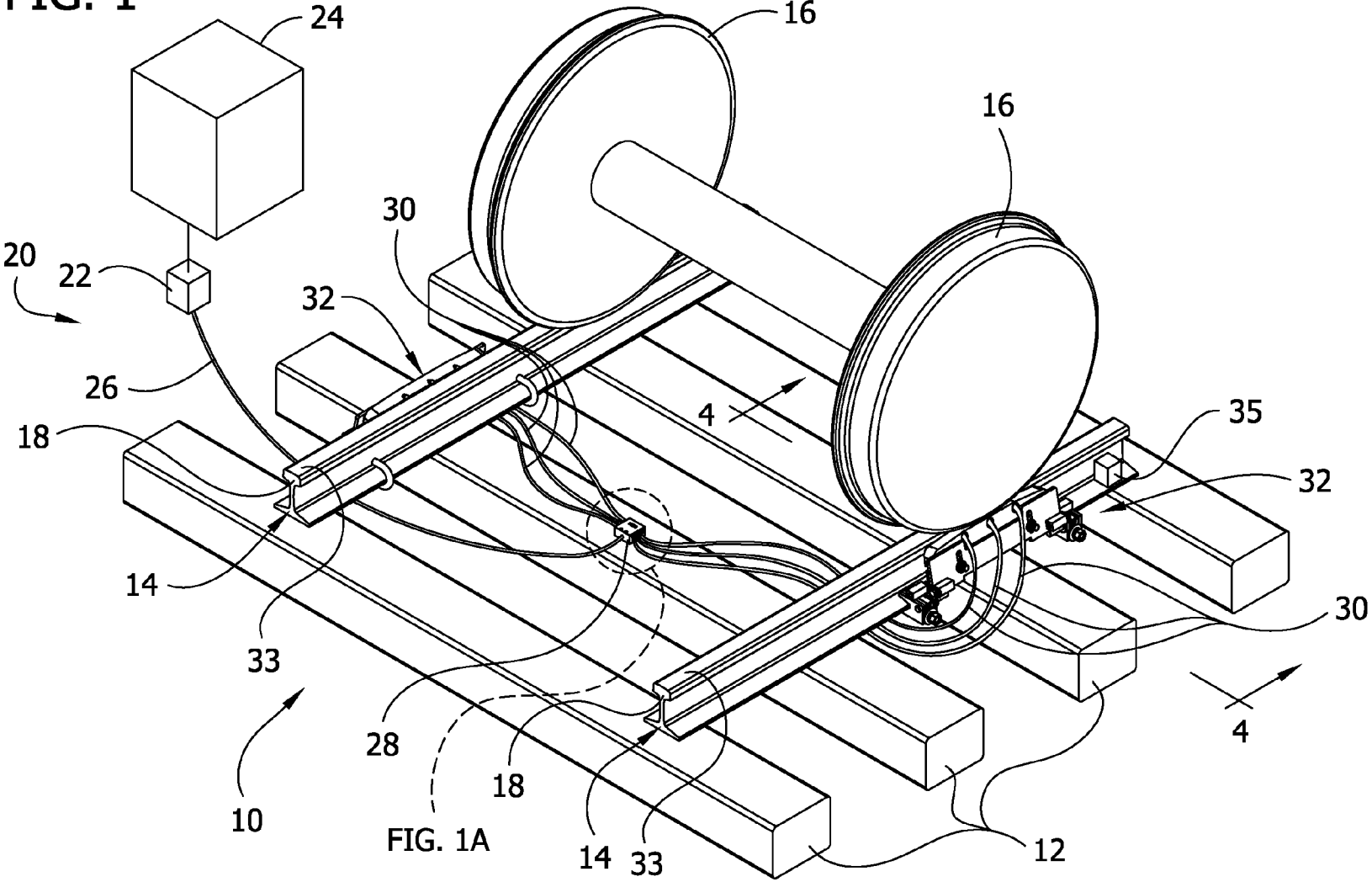
FIG. 1 is a perspective of a section of railroad track and a system for applying pumpable material to the rails of the track, a portion of the system being illustrated schematically.

Referring to FIG. 1, a conventional railroad track, generally indicated at 10, is shown as comprising a series of rail ties 12 and a pair of parallel rails, each generally indicated at 14. Train wheels 16 rolling on the rails 14 are also shown. A system of this invention for applying a pumpable material to a rail head 18 of each rail 14 is indicated generally at 20. The system is particularly adapted for applying a friction modifying material to the rail head 18, and even more particularly adapted for applying a material that controls the friction between the rail 14 and the wheels 16 of a train. A suitable pump 22 delivers the pumpable material under pressure from a reservoir 24 through a main conduit 26 to the inlet 27 of a divider or distribution valve 28. For example, the pump may be a 24 VDC electric Flowmaster® pump, and the distribution valve may be a SSV Metering Device with cycle switch, both of which are manufactured and sold by Lincoln Industrial Corp., St. Louis, Mo. The distribution valve 28 equally divides the flowing material into multiple auxiliary conduits 30, which direct the material to a pair of applicator apparatuses 32. Each apparatus 32 is positioned adjacent a respective rail 14 on the outboard (field) side of the rail for applying the friction modifying material to a top surface 33 of the rail head 18. As described in more detail below, the system 20 includes a wheel sensor 35 for detecting the presence of a train as it passes by the sensor. As illustrated schematically in FIG. 11 and explained in more detail below, the system 20 also includes a pressure switch 37 fluidly connected to the main conduit 26 between the pump 22 and the distribution valve 28. The pump 22, the distribution valve 28, the wheel sensor 35, and the pressure switch 37 are interfaced with a controller 39, such as a microcontroller.

Figure 2:
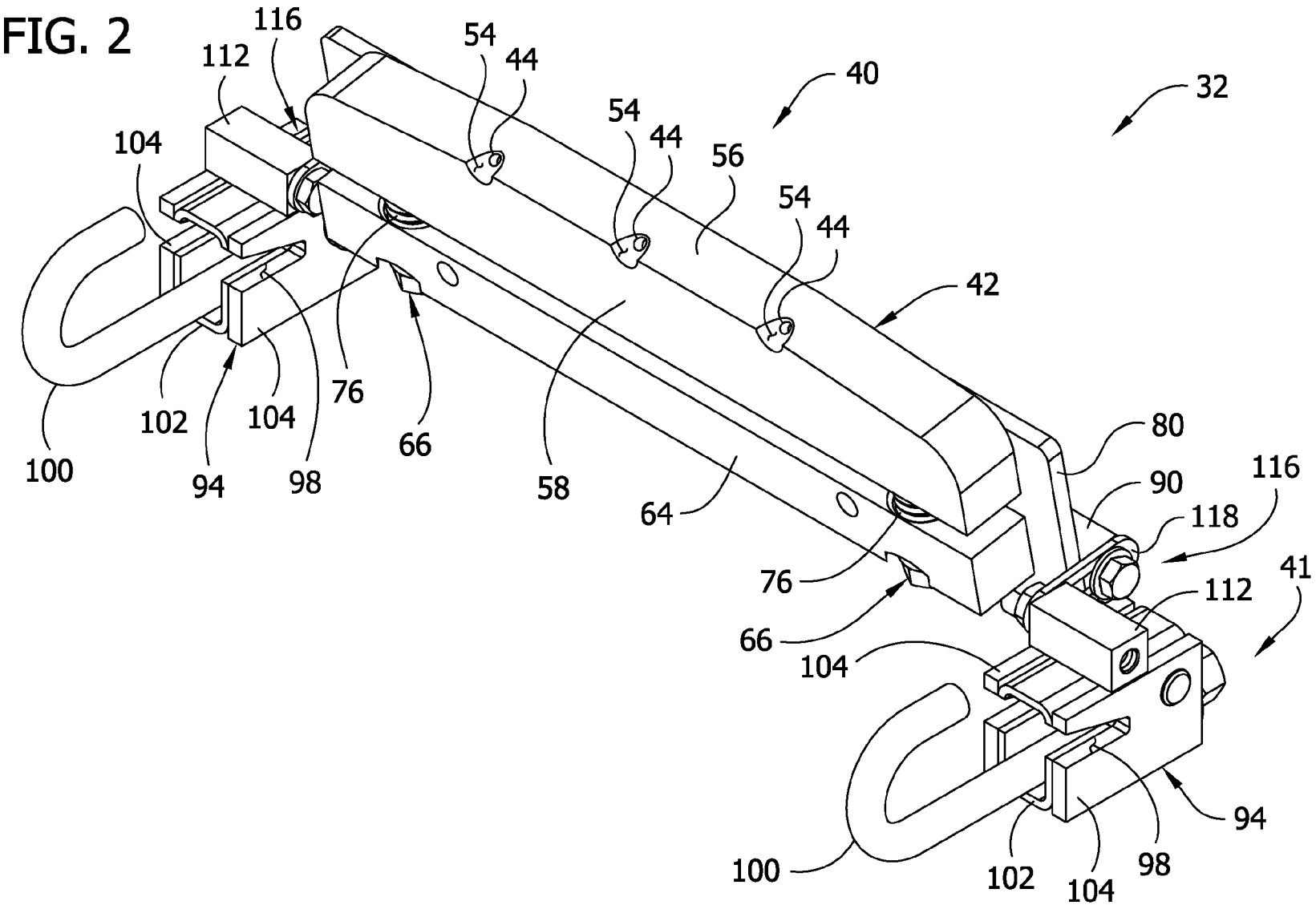
FIG. 2 is a front perspective of an applicator apparatus of the system of FIG. 1.

Referring to FIG. 2, each applicator apparatus 32 comprises an applicator assembly 40 and a securing device 41 for securing the applicator assembly to the respective rail 14. Each applicator assembly 32 comprises an applicator bar (broadly, an applicator body), generally indicated at 42, having three orifices 44 spaced along a length of the bar for receiving a pumpable material from the distribution valve 28 and delivering the material to the rail head 18. It is understood that the applicator bar 42 may have more or less orifices without departing from the scope of the present invention.

Figure 4:
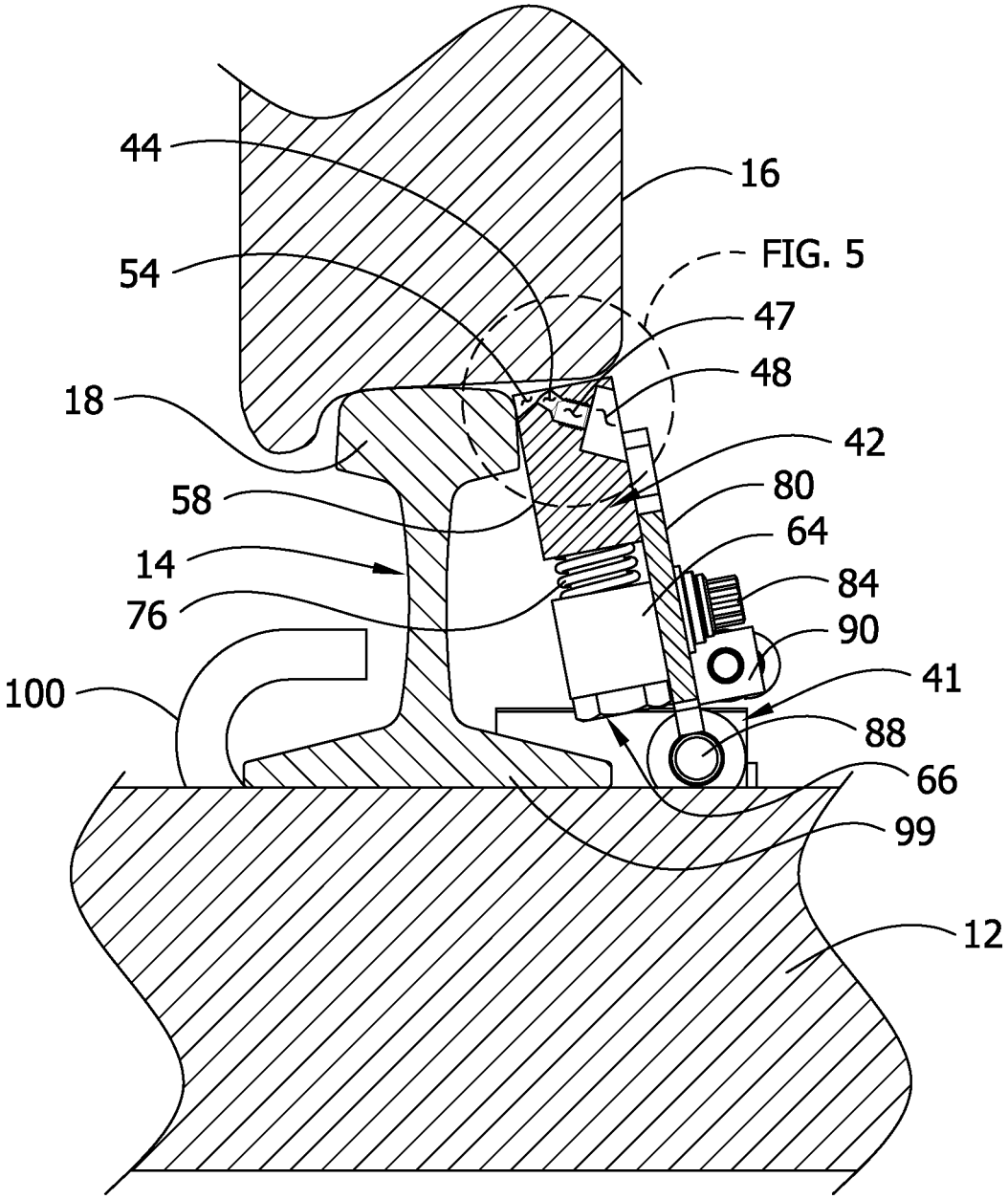
FIG. 4 is a cross-sectional view of the applicator apparatus and associated rail taken in the plane containing the line 4-4 in FIG. 1.
Figure 5:
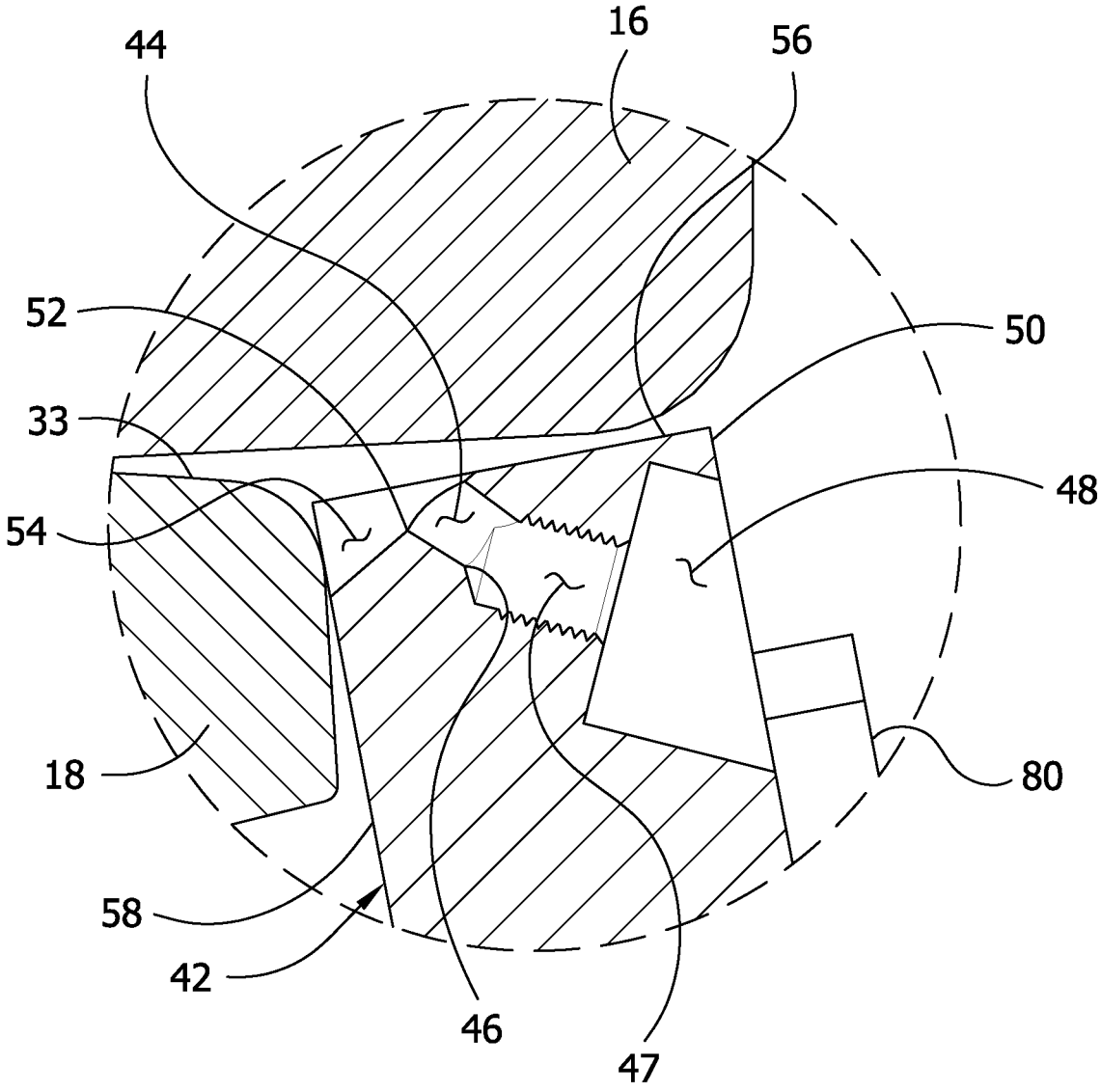
FIG. 5 is an enlarged, fragmentary cross-sectional view of a portion of FIG. 4.
Figure 6:
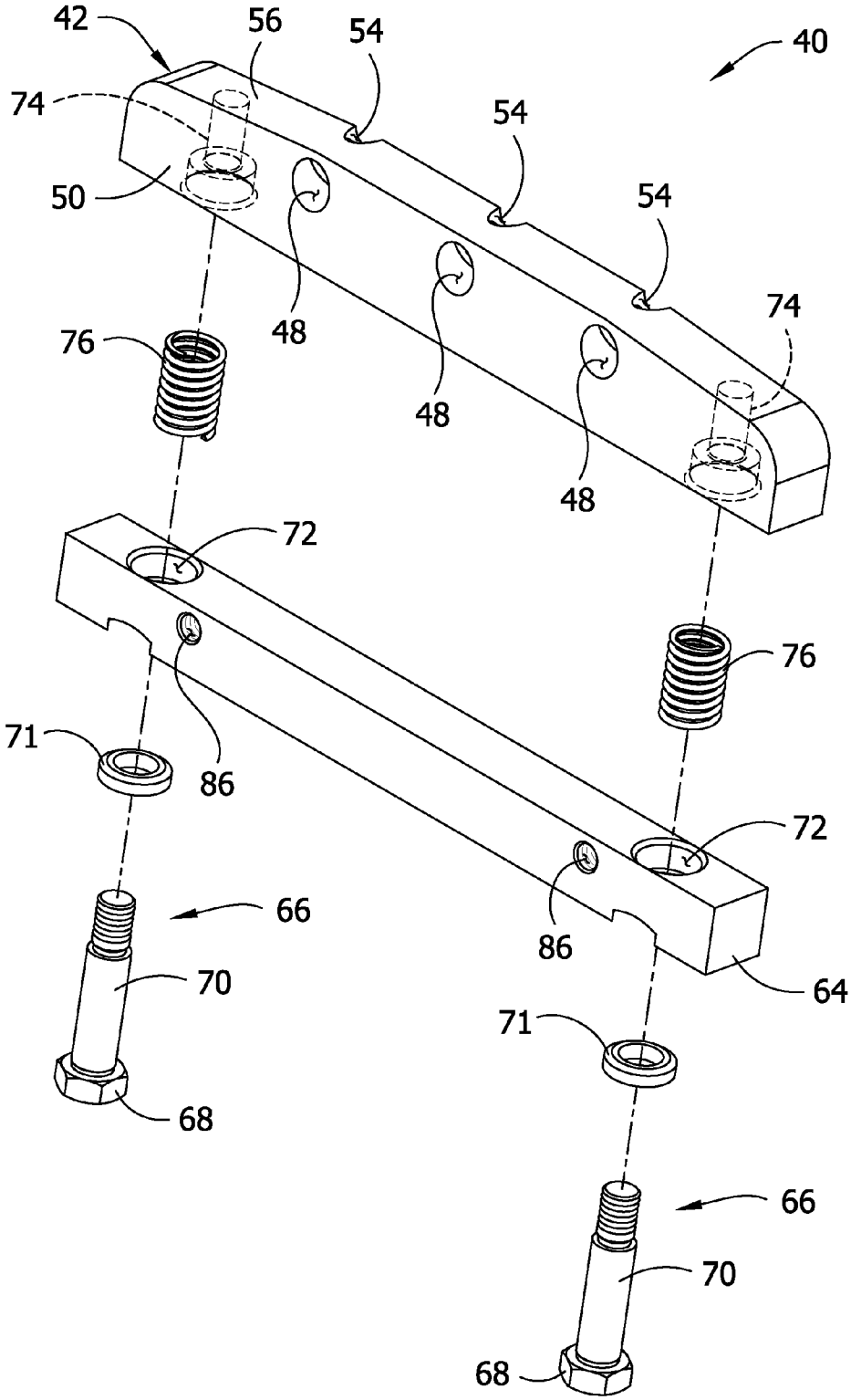
FIG. 6 is an exploded view of an applicator assembly of the applicator apparatus.

Referring to FIGS. 4 and 5, each orifice 44 has an inlet 46 (FIG. 5) within the bar 42 communicating with a threaded bore 47 in the bar. The threaded bore 47 is sized and shaped to connect a threaded conduit fitting (not shown) on the end of one of the auxiliary conduits 30 to the bar 42 to deliver pumpable material to the orifice 44. A counter bore 48 extending through the outboard face 50 of the bar 42 provides clearance for threading the conduit fitting in the bore 47. Each orifice 44 also has an outlet 52 (FIG. 5) which terminates at a discrete recess 54 formed in a top surface 56 and an inboard face 58 of the applicator bar 42. The orifice outlets 52 are disposed below the top surface 56 of the bar 42 by virtue of the recesses 54, thus protecting the orifices against damage from the train wheels 16 passing over the applicator assembly 34, as will be discussed later. As shown best in FIG. 2, each recess 54 has a generally concave surface which is configured to flare outward away from the orifice outlet 52 so that material exiting the orifice 44 spreads to cover a larger surface of the rail head 18. Other recess configurations are possible. For reasons explained below, each orifice 44 tapers from its outlet 52 to its inlet 46 so that the inlet has a smaller cross-sectional area or diameter than the outlet.

Figure 1A:
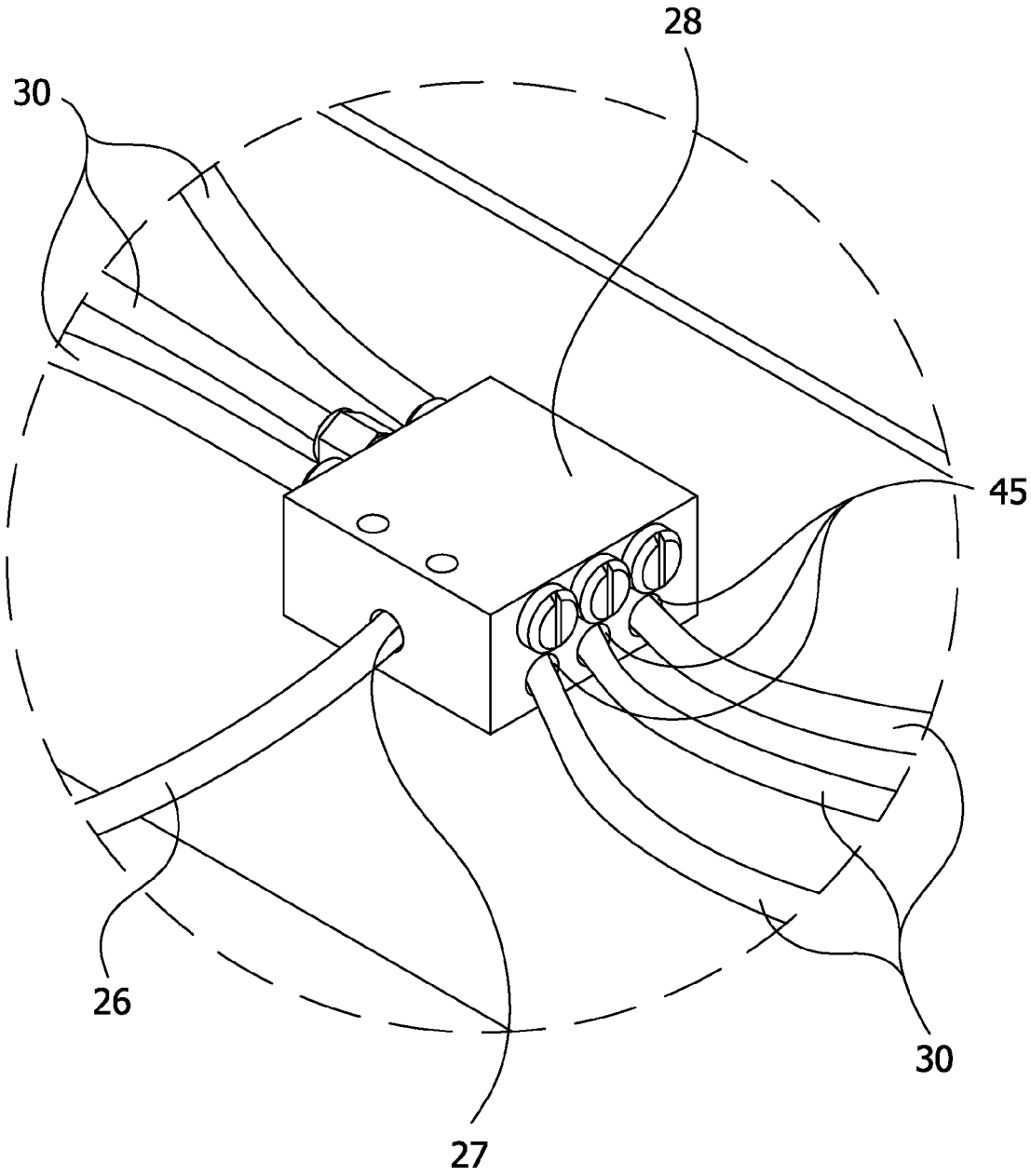

Referring to FIGS. 1 and 1A, the illustrated distribution valve 28 includes a single inlet 27 and six outlets 45, three of which direct material to one of the applicator bars 42 and the other three direct pumpable material to the other of the applicator bars. As briefly stated above, the valve 28 is a progressive, positive displacement valve that equally or substantially equally divides the pumpable material so that the same amount or substantially the same amount of material exits the valve through each of the outlets 45. A suitable valve of this type is described in detail in U.S. Pat. No. 6,719,095, which is assigned to Lincoln Industrial Corporation and is incorporated herein by reference. Each outlet 45 is dedicated to only one of the orifices 44, and each auxiliary conduit 30 is dedicated to one of the orifices and one of the outlets to fluidly connect the respective outlet and orifice. This arrangement of the dedicated valve distribution outlets 45 and auxiliary conduits 30, along with the tapered orifices 44, facilitates removal of any dried pumpable material and/or other debris clogging the orifices 44. If one or more of the orifices is clogged, the pumpable material being delivered from the distribution valve 28 cannot exit the respective conduit 30 because the clogged orifice 44 is the only exit. Thus, fluid pressure increases at the inlet 46 of the orifice(s) because the distribution valve will continue to direct the same amount of material to each of its outlets, including the outlet(s) associated with the clogged orifice(s), regardless of any fluid pressure differential between the outlets. The inlet 46 further facilitates a large fluid pressure build-up because of its small cross-sectional area. The fluid pressure continues to increase at the inlet 46 until the dried material causing the blockage is forced out of the orifice, allowing the pumpable material to flow through the orifice to the rail head 18.

Referring to FIGS. 2, 4, 6 and 7, the applicator assembly 40 also includes a base 64 positioned below the applicator bar 42. The base 64 is also elongate in the illustrated embodiment, having a length comparable to the length of the applicator bar 42, although other lengths not comparable to the applicator bar are possible. As shown best in FIG. 6, two bolts (broadly, guides), each generally indicated at 66, connect the base 64 and the applicator bar 42 for guiding the applicator bar between raised and depressed positions, as will explained. Each bolt 66 has a head 68 and a shank 70 with a threaded free end. The shank 70 of the bolt 66 extends up through a bushing 71 received in a clearance through bore 72 in the base 64, and the free end of the shank 70 is threaded into a blind bore 74 in the applicator bar 42. The head 68 of the bolt 66 contacts the bushing 71 and presses the bushing against the bottom of the base 64.

Coil compression springs 76 are disposed around the shanks 70 of the bolts 66 between the applicator bar 42 and the base 64 and function to urge the applicator bar 42 toward its raised position (FIGS. 4 and 5) in which the orifices 44 are located for delivering the friction modifying material to the top surface 33 of the rail head 18. The springs 76 are resiliently yieldable to permit the applicator bar 42 to move to its depressed position in the event the applicator bar is contacted by a train wheel 16. Typically, the wheels 16 on a train will not contact the applicator bar 42 of the applicator assembly 40. However, if the wheel 16 and/or the rail head 18 are worn, contact is possible. If contact occurs, the applicator bar 42 will move in a downward direction against the bias of the springs 76 to prevent or minimize damage to the bar. The bar 42 automatically returns to its initial position after such contact has ended. The fact that the outlets 52 of the orifices 44 are disposed below the top surface 56 of the bar 42 due to the recesses 54 further reduces any risk of damage to the orifices. It will be understood that the configurations of the applicator bar 42 and the bolts 66 and the numbers of bolts and/or springs can vary without departing from the scope of this invention. Further, other ways of guiding the applicator bar or body besides the use of bolts 66 are within the scope of the invention.

Figure 7:
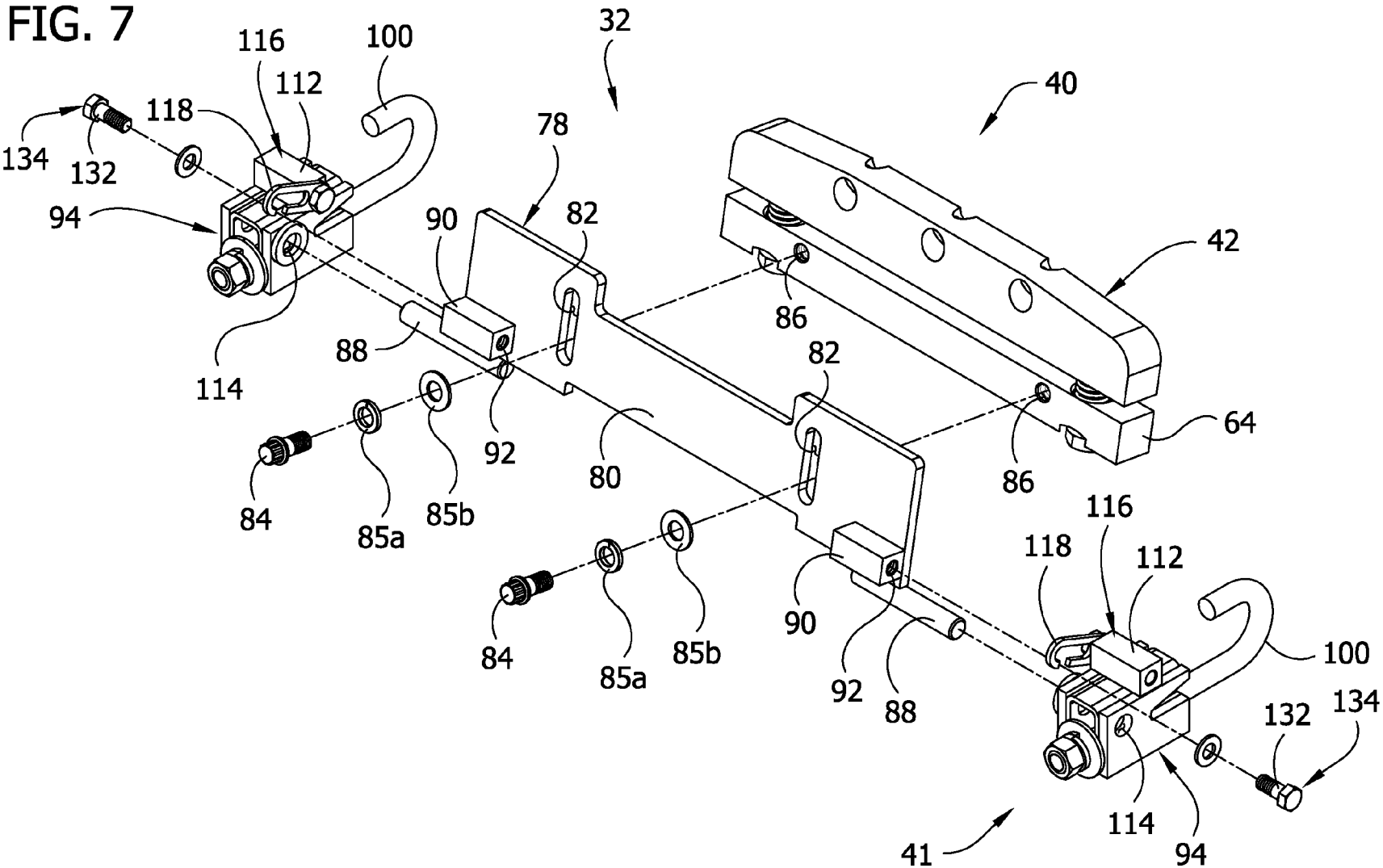
FIG. 7 is an exploded view of the applicator apparatus.

Referring to FIG. 7, the applicator assembly 40 also includes a mount, generally indicated at 78, for mounting the base on the securing device 41. In the illustrated embodiment (see FIG. 7), the mount 78 comprises an elongate mounting plate 80 having opposite end sections connected by a narrower central section. The end sections have a pair of parallel vertical slots 82 therein for receiving fasteners 84 which thread into blind bores 86 in the base 64 to fasten the base to the mount 78. The fasteners 84 press lock washers 85*a* and flat washers 85*b* against the mounting plate 80. The fasteners 84 are loosened to permit vertical adjustment of the base 64 and applicator bar 42 relative to the mount 78 and then tightened to secure the base in fixed position with the orifices 44 in the bar at the desired position relative to the top surface 33 of the railhead 18. The mount 78 also includes a pair of pivot rods 88 extending laterally (horizontally) outward from the ends sections of the mounting plate 80 for pivotable attachment to the securing device 41, as will be explained. A pair of locking blocks 90, each defining a threaded blind bore 92, fixes the applicator assembly 40 in a selected angular working position, as will also be explained.

Figure 3:
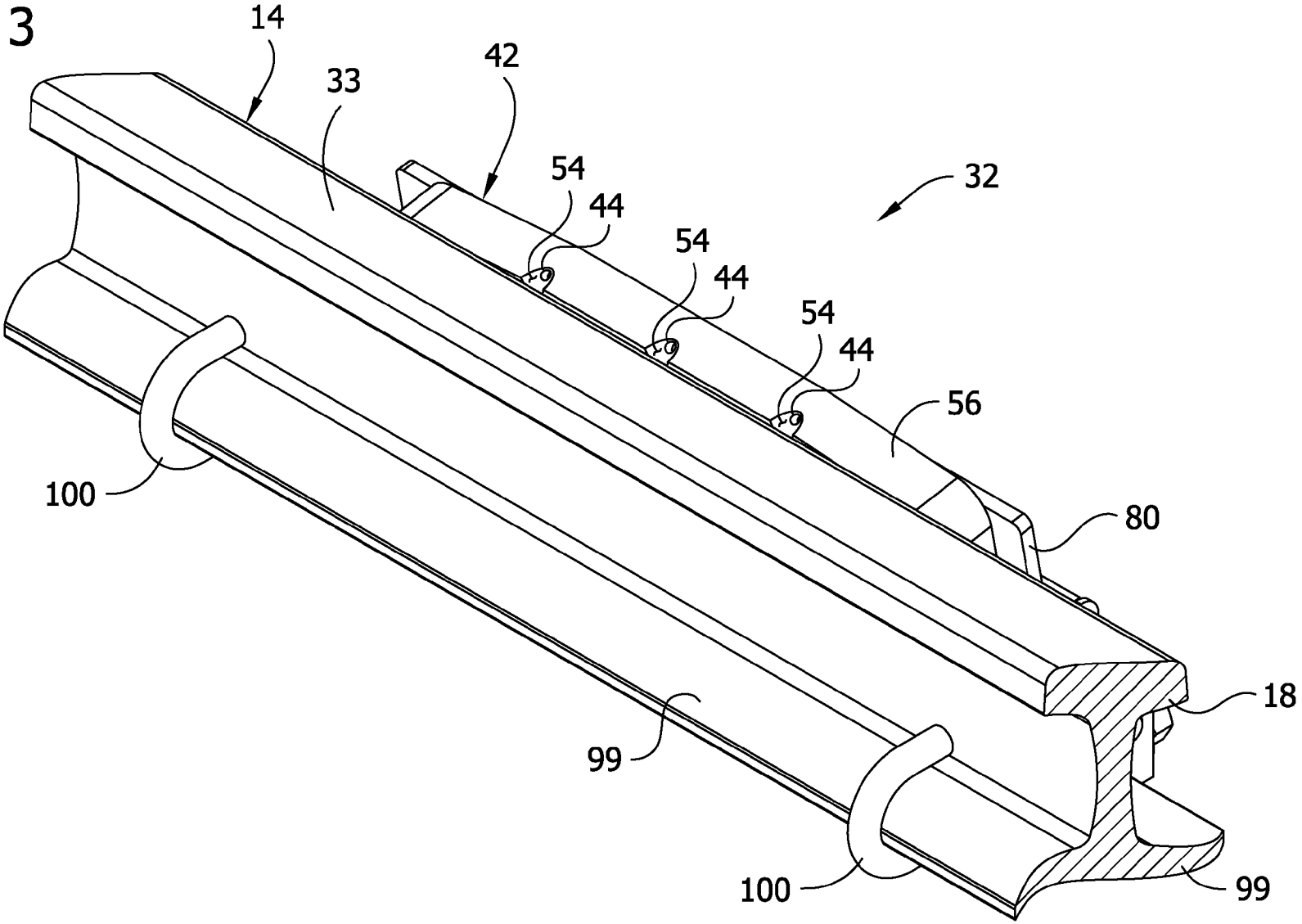
FIG. 3 is a perspective of the applicator apparatus secured to a section of railroad track.

Referring still to FIG. 7, the securing device 41 comprises a pair of clamps, each generally indicated at 94, for clamping against a lower flange 99 (FIG. 9) of the rail 14. Each clamp 94 comprises a base, generally indicated at 97, having a notch 98 in one end for receiving an outboard edge of a lower flange 99 of the rail 14 (FIG. 9), and a J-bolt 100 attached to the base for clamping against an inboard edge of the lower flange (FIG. 3). In the illustrated embodiment, as shown best in FIG. 8, the base 97 of the clamp 94 includes a rectangular center tube 102 and a pair of side plates 104 affixed (e.g., by welding) to opposite sides of the center tube. The center tube 102 is adapted for receiving a threaded end of the respective J-bolt 100, which is tightened into clamping engagement with the rail 14 by threading a nut 106 on the J-bolt against a spring-lock washer 108 and a flat washer 110 which butts up against the center tube. The clamp 94 may be fabricated in other ways. For reasons which will appear, a pivot block 112 is attached, such as by welding, to a top face of the base 97. Other devices may be used for securing the applicator assembly 40 to the rail 14.

Figure 9:
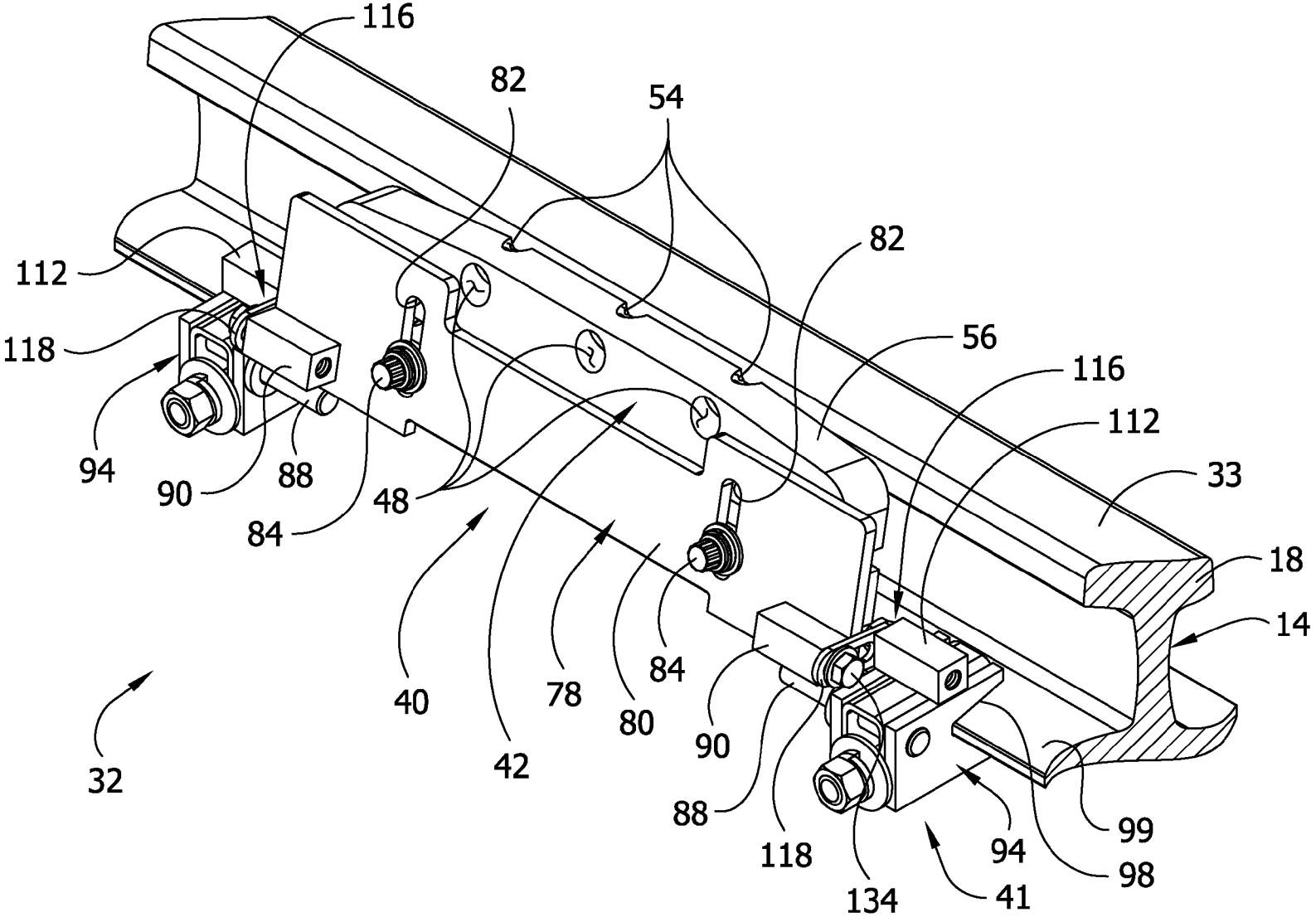
FIG. 9 is a perspective of an applicator assembly secured to a section of railroad track and in its working position.
Figure 10:
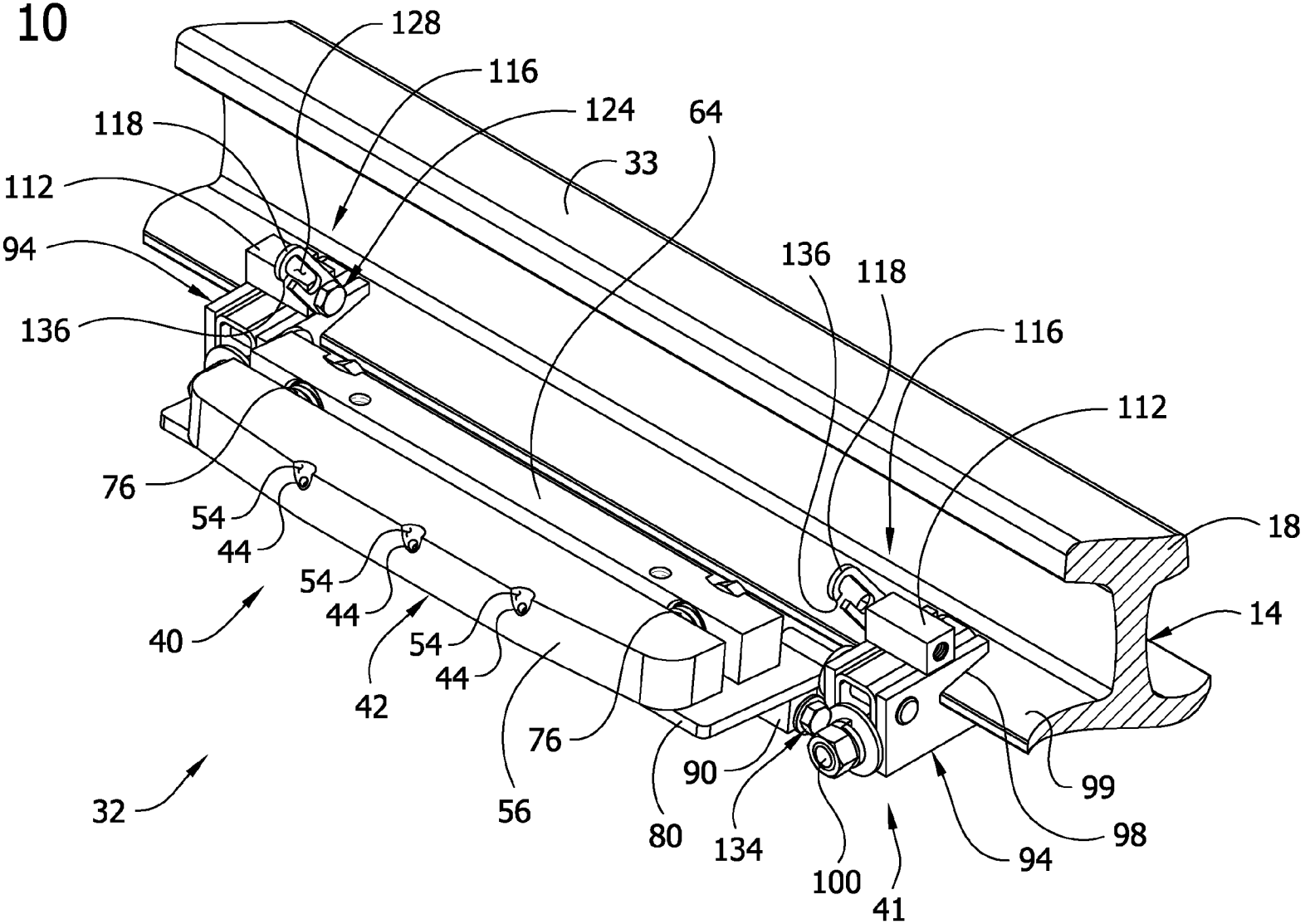
FIG. 10 is a view similar to FIG. 9 but showing the applicator assembly in its rail-servicing position.

Referring to FIG. 7, the pivot rods 88 of the mount 78 are received in horizontal bores 114 in the bases 97 of the two clamps 94 to allow the applicator assembly 40 to be pivoted upward and downward about a generally horizontal axis between a working position, as shown in FIGS. 3, 4 and 9, and a rail-service position, as shown in FIG. 10. In the working position, the applicator bar 42 of the assembly 40 is adjacent to the rail head 18, and preferably closely adjacent the rail head, and even more preferably in contact with the rail head to minimize material leaking down between the rail head and the bar to the ground. In the rail-service position, the applicator bar 42 is remote from the railhead 18 so that the rail 14 may be serviced. The applicator assembly 40 may be movable between the stated working and rail-service positions in other ways.

Figure 8:
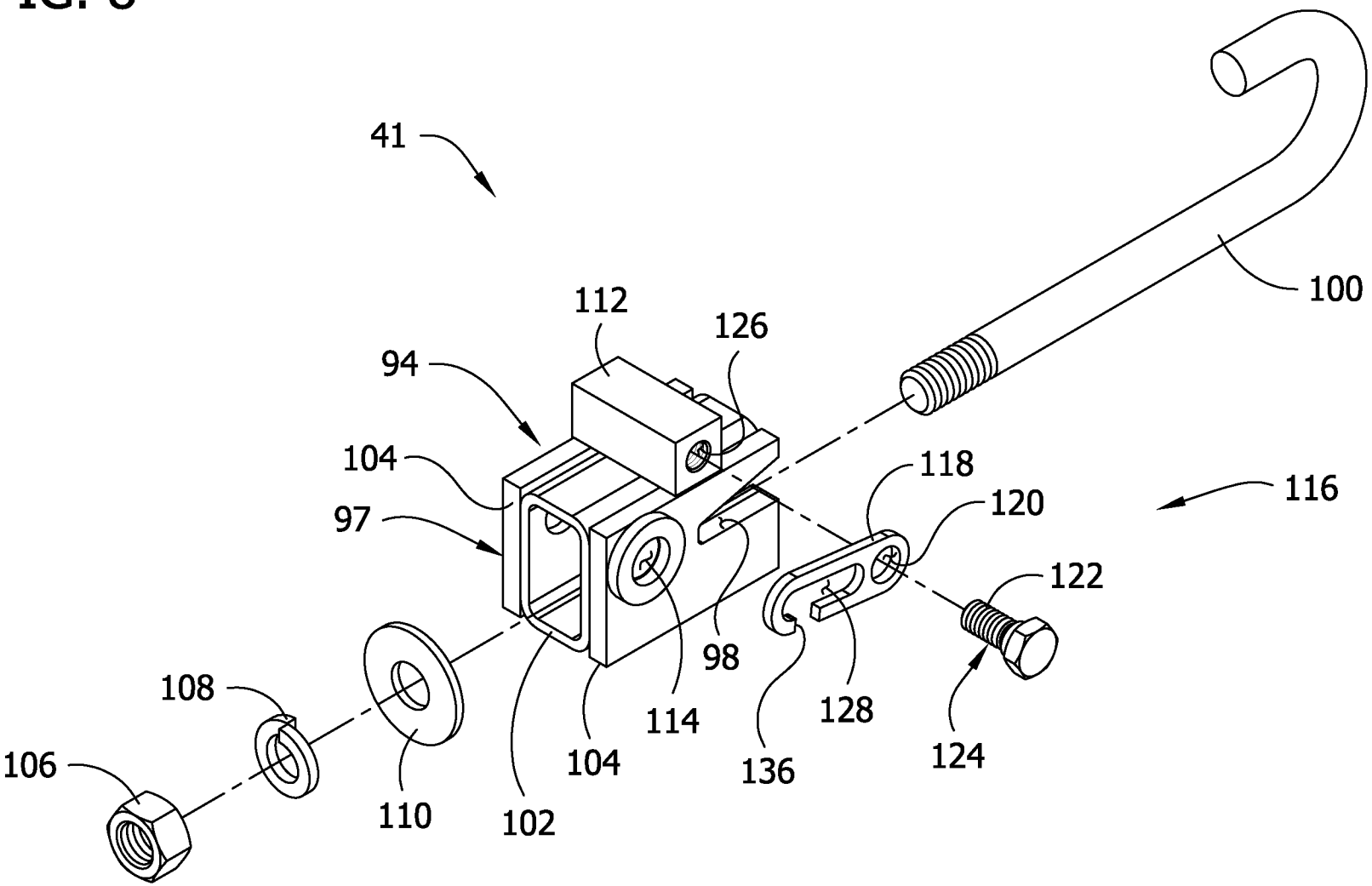
FIG. 8 is an exploded view of a securing device of the applicator apparatus.

Referring to FIG. 7, a releasable locking mechanism, generally designated 116, is provided for locking the applicator assembly 40 in its working position and for unlocking the applicator assembly to permit movement of the applicator assembly to its rail-service position. In one embodiment, this locking mechanism 116 comprises a latching bar 118 pivotally attached to each of the pivot blocks 112 on the bases 97 of the clamps 94. Referring particularly to FIG. 8, each latching bar 118 has a clearance hole 120 adjacent one end for receiving the shank 122 of a pivot member (e.g., a threaded bolt), generally indicated at 124, which threads into a bore 126 in a respective pivot block 112. A slot 128 extends lengthwise of the latching bar 118 from a location adjacent the end of the bar opposite the clearance hole 120.

As shown best in FIG. 7, a shank 132 of a locking member (e.g., threaded bolt), generally indicated at 134, extends through the slot 128 of the latching bar 118 and threads into the bore 92 of the locking block 90 affixed to the mounting plate 80. Tightening the locking member 134 in the locking block 90 locks the applicator assembly 40 in a selected position, while loosening the locking member permits movement of the locking member in the slot 128 along the length of the latching bar 118 to provide limited pivotal adjustment of the applicator assembly.

The latching bar 118 also has an opening 136 extending transversely into the slot 128. When the locking member 134 is loosened in the locking block 90, the latching bar 118 may be pivoted upward about the pivot member 124 so that the latching bar disengages the locking member as the locking member exits the slot 128 through the transverse opening 136. When the latching bars 118 and locking members are disengaged, the applicator assembly 40 may be pivoted down to its rail-servicing position. The transverse opening 136 also permits the locking member 134 to enter the slot 128 as the latching bar 118 is rotated downward to reengage the latching bar and the locking member.

To install each applicator assembly 40 on the respective rail 14, the pivot rods 88 are inserted into the horizontal bores 114 of the clamps 94, and the clamps are secured to the rail. The applicator assembly 40 is rotated to a generally vertical position, and the latching bars 118 are rotated downward so that the locking members 134 enter the slots 128 through the transverse openings 136. With the locking members 134 received in the slots 128, the height of the applicator bar 42 is adjusted by loosening the fasteners 84 extending into the base 64 of the applicator assembly 40 and sliding the base upward or downward relative to the mounting plate 80 so that the outlets 52 of the orifices 44 are generally adjacent to the top surface 33 of the rail head 18. The fasteners 84 are tightened to lock the applicator bar 42 in the selected vertical position.

The angular position of the assembly 40 is adjusted by pivoting the assembly about the pivot members 88 in the clamps 94 so that the inner face 58 of the bar contacts the rail 14. As stated above, the slots 128 allow limited pivotal movement of the assembly 40 when the locking members 134 are received in the slots. With the applicator assembly 40 in the proper working position, the assembly 40 is locked by tightening the locking members 134 extending through the latching bars 118. In this position, the applicator assembly 34 is in its proper working position so that material dispensed from each orifice 44 is applied to the top surface 33 of the rail head 18. The auxiliary conduits 30 may be secured to the applicator assemblies 40 and the remaining components of the system 20 may be connected and assembled before or after attaching the applicator assemblies to the respective rails 14.

After installation, each assembly 40 may be selectively and repeatedly moved to the rail-service position to service the respective rail 14 and back to the working position after service. To move each applicator assembly 40 to the rail-service position, the locking members 134 are loosened, and the latching bars 118 are pivoted upward so that the locking members exit the slots 128 through the transverse openings 136. With the latching bars 118 disengaged from the locking members 138, the assembly 40 may be rotated down to its rail-servicing position. After service on the rail 14 has been completed, the assembly 40 is rotated up and properly positioned in its working position in the manner described above with respect to installation.

As mentioned above and schematically illustrated in FIG. 11, the pump 22, the distribution valve 28, the wheel sensor 35 and the pressure switch 37 are interfaced with the controller 39. Dashed lines in FIG. 11 indicate communication between the controller 39 and respective components, while solid lines indicate fluid communication, such as the main conduit 26 and the auxiliary conduits 30. Communication between the controller 39 and the components may be transmitted through wires or may be wireless.

Figure 11:
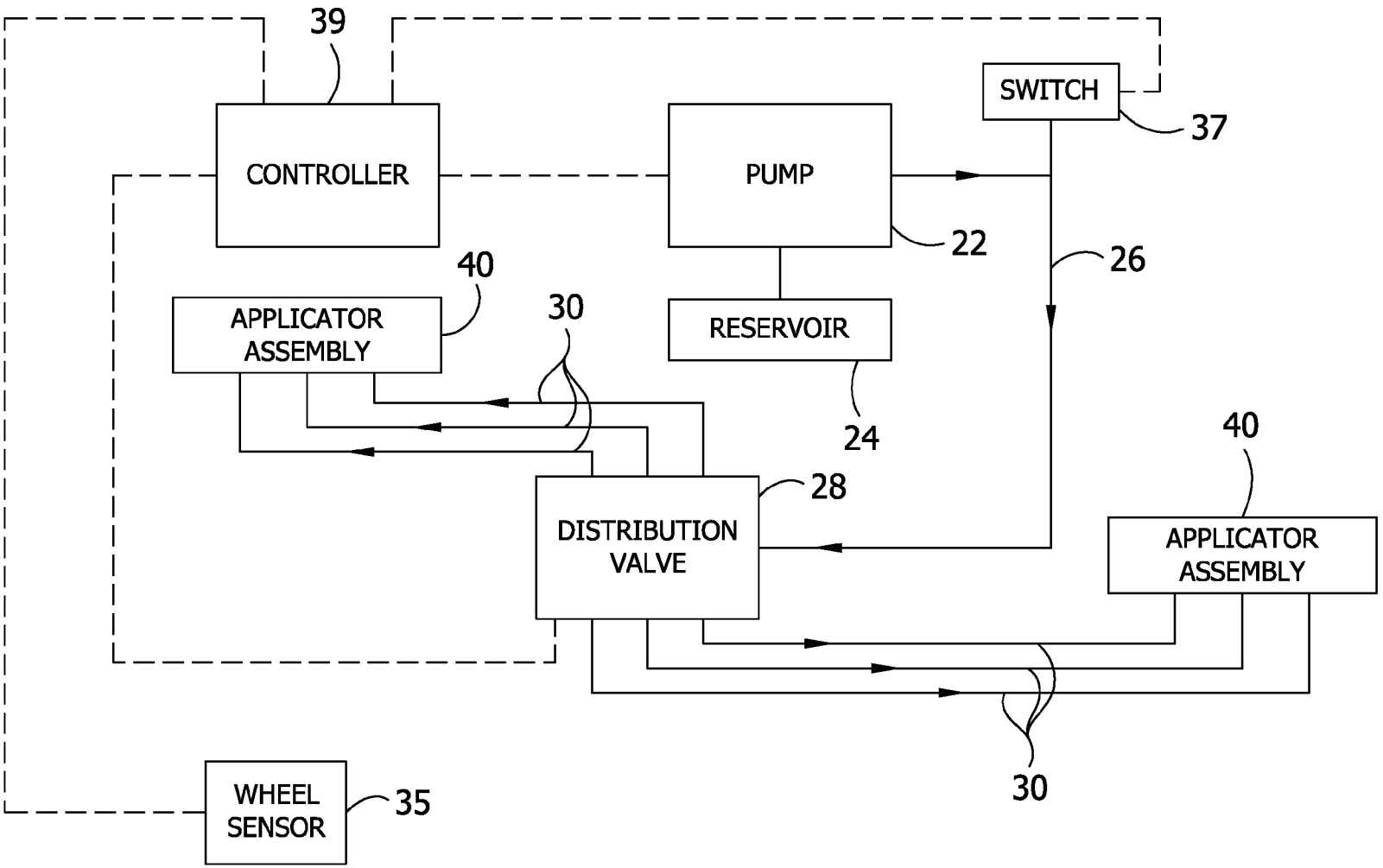
FIG. 11 is a schematic diagram of the system.

Referring to FIGS. 1 and 11, when the applicator assemblies 40 are in their working positions and a train is approaching the wheel sensor 35 detects the wheels 16 of the train and sends an electrical wheel signal indicative of such detection to the controller 39. Each time the sensor 35 detects a wheel, a signal is sent to the controller 39. To ensure that the friction modifying material is not delivered until after the locomotive (s) of the train has passed the applicator assemblies 40, the controller 39 does not immediately activate the pump 22 upon receipt of the wheel signal. Instead, the controller 39 is programmed to activate an internal time-counter and an internal wheel-counter. Using the time-counter, the controller 39 records an amount of time that has elapsed from when it received the first wheel signal. Using the wheel-counter, the controller 39 records the number of wheel signals received by the controller from the wheel detector. An adjustable, preset time-threshold and an adjustable, preset first wheel-threshold is programmed in the controller 39 so that after both the time-counter reaches the time-threshold and the wheel-counter reaches the first wheel-threshold, an activation signal is sent by the controller to pump 22. The activation signal activates the pump 22 to deliver the friction modifying material to the distribution valve 28 via the main conduit 26. The pressure switch 37 is fluidly connected to the main conduit 26 and sends a malfunction signal to the controller 39 if the distribution valve 28 or fluid lines are clogged. The controller 39 shuts down the pump 22 if the controller receives the malfunction signal to prevent damaging the pump and/or other parts of the system.

Referring still to FIGS. 1 and 11, the distribution valve 28 divides the material flow equally into the multiple auxiliary conduits 30. The distribution valve 28 measures the volume of material flowing to the auxiliary conduits 30 and sends a cycle-signal to the controller 39 when a preset volume (e.g., 0.036 $in^3$) of material has been delivered to each of the applicator assemblies 40. The controller 39 is programmed to activate an internal cycle-counter to record the number of cycle signals it receives from the distribution valve 28. When the cycle-counter reaches an adjustable, preset cycle-threshold, the controller 39 sends a deactivation-signal to the pump 22 and the pump deactivates.

The wheel sensor 35 continuously sends the wheel-signals to the controller 39 after detection of the first wheel 16, and the controller continuously records the number of signals received using the wheel counter. When the wheel-counter reaches an adjustable, preset second wheel-threshold, the controller 39 sends another activation-signal to the pump 22 to begin another round of application of the material. The controller 39 may be adjustably programmed to deliver additional cycles or rounds of applications to the rails 14. When the wheel sensor 35 is no longer detecting the wheels 16 of the train (e.g., when a certain threshold amount of time has passed since the wheel detector last sent a signal to the controller 39), the controller, the pump 22 and the distribution valve 28 are turned off to conserve energy until the wheel sensor sends another signal indicative of another train to the controller.

Having described the illustrated embodiments of the invention in detail, it will be apparent that modifications and variations are possible without departing from the scope of the invention defined in the appended claims.

Figure 12:
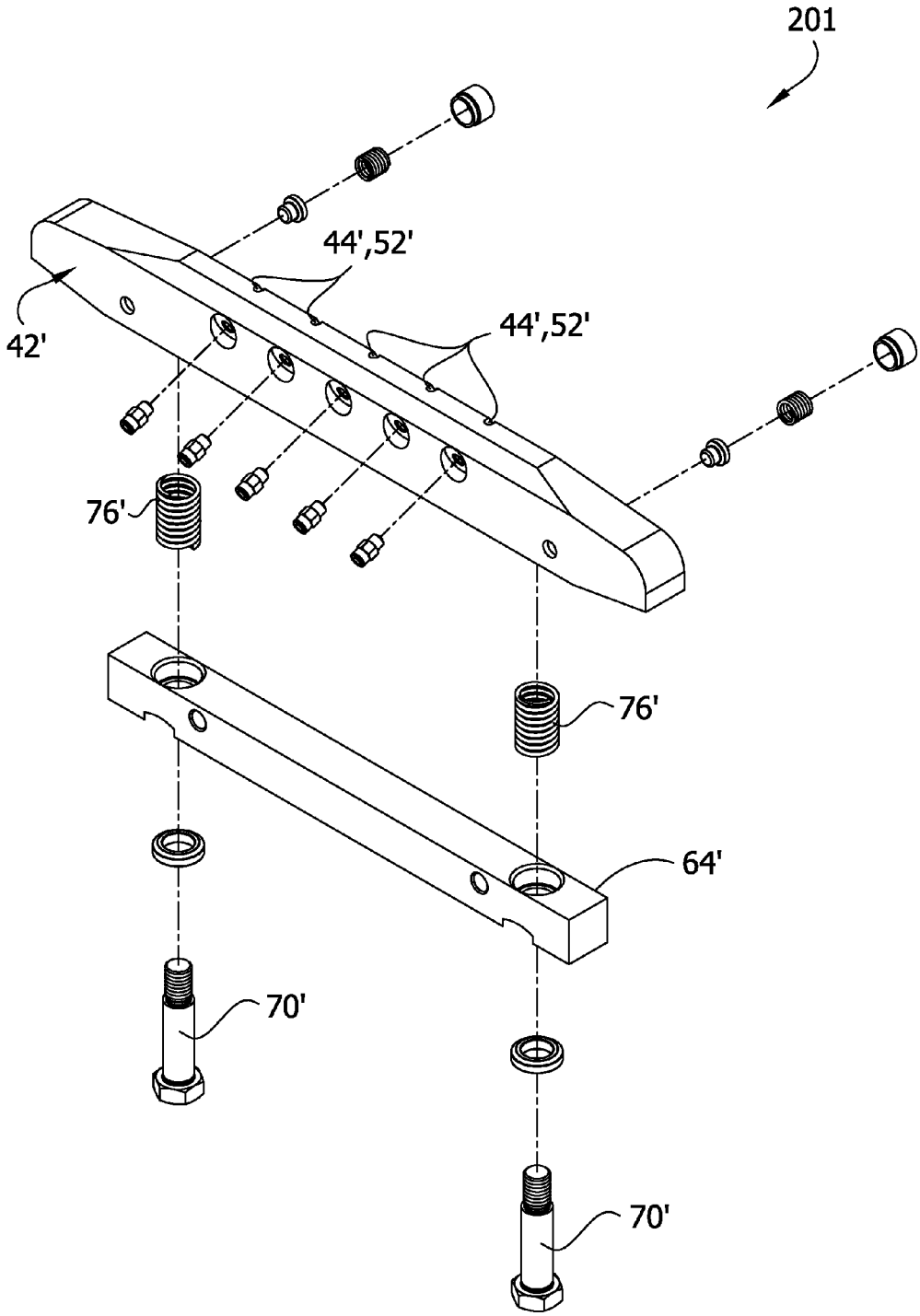
FIG. 12 is an exploded perspective view showing components of a second embodiment of apparatus of this invention.
Figure 13:
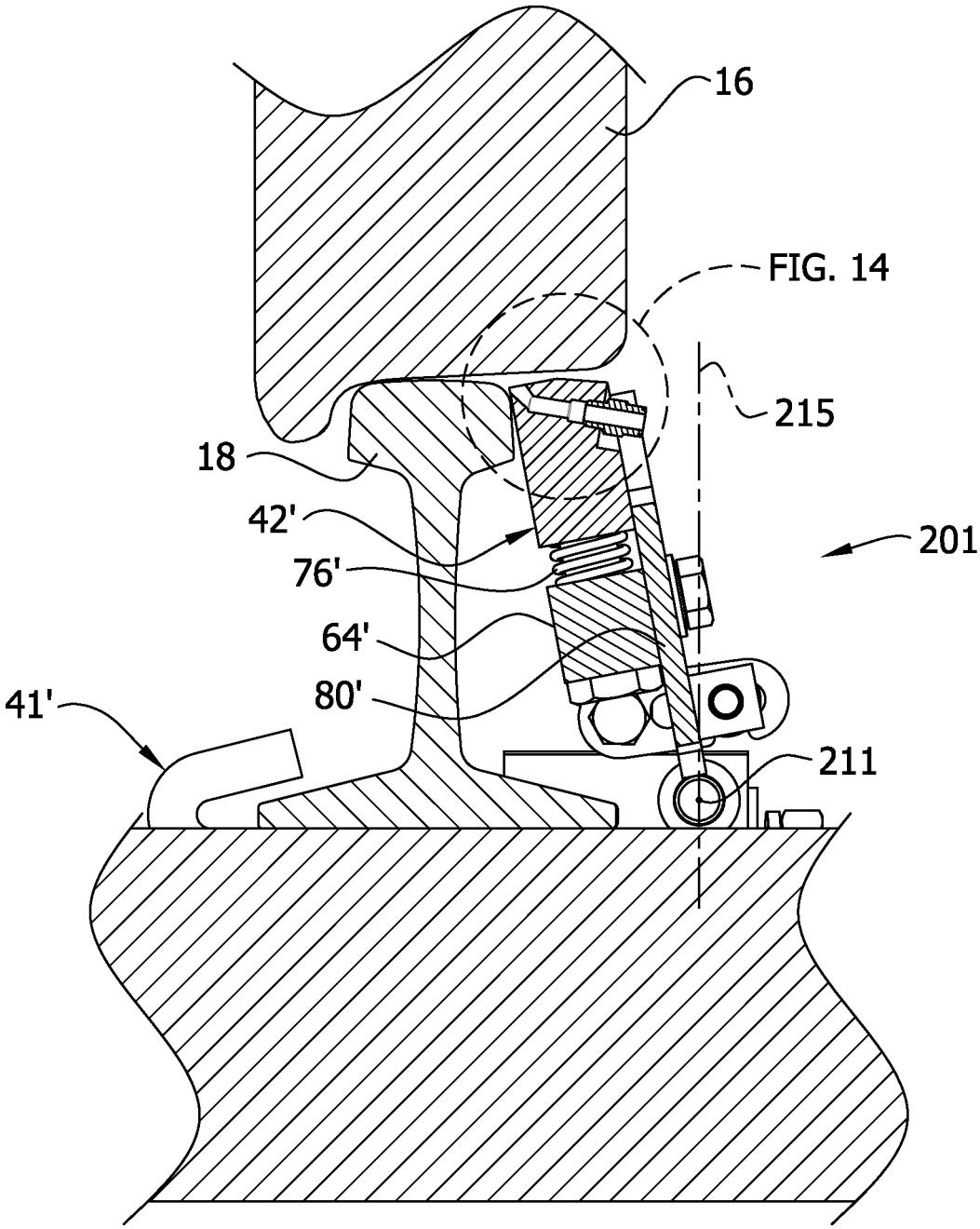
FIG. 13 is a vertical section through an applicator assembly of the apparatus of FIG. 12 showing an applicator bar in contact with the head of a rail to form a hard seal inhibiting leakage of pumpable material down past the seal.
Figure 14:
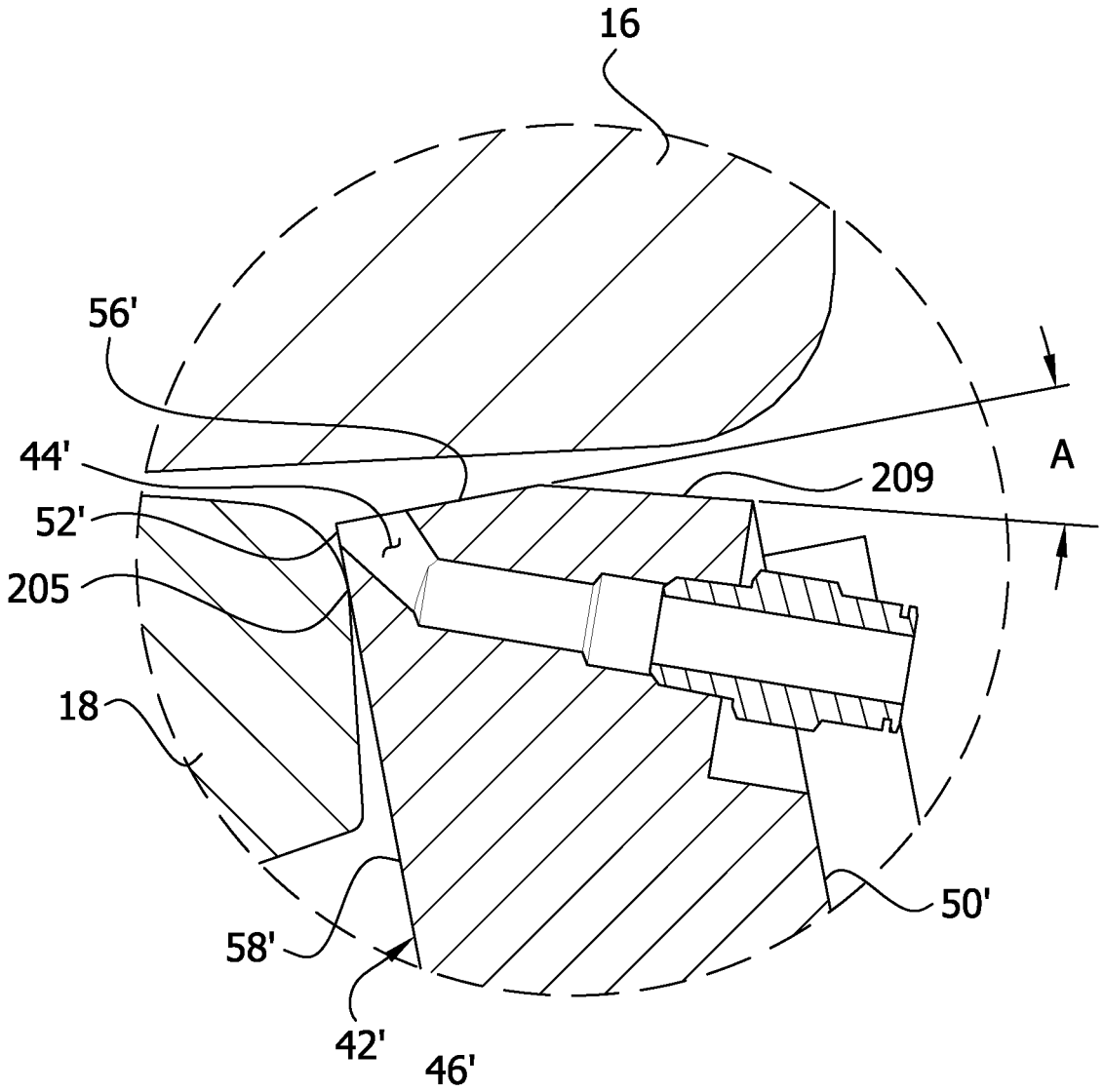
FIG. 14 is an enlarged portion of FIG. 13 showing the hard seal.

FIGS. 12-17 show a second embodiment of the present invention, generally designated 201. The apparatus of this embodiment is similar to the apparatus of the previous embodiment and corresponding parts are indicated by corresponding reference numbers with the addition of a prime (') designation. As best illustrated in FIGS. 13 and 14, when the applicator bar 42' is in its working position, the inboard face 58' of the bar contacts the rail head to form a metal-on-metal hard seal 205 which extends lengthwise of the rail head. The hard seal 205 functions to inhibit the leakage of friction modifying material down from the rail head 18 and eliminates the need for conventional "soft" seals, i.e., seals of rubber or other relatively soft material, which tend to wear down over time and need to be replaced. Desirably, the contact area 205 between the inboard metal face 58' of the applicator bar 42' and the rail head 18 extends substantially the full length of the applicator bar. In the embodiment shown in the drawings (e.g., FIG. 14), the contact area defining the hard seal 205 is a relatively narrow area in the vertical direction, but the bar 42' can be configured to provide wider seal areas without departing from the scope of this invention. Further, the hard seal 205 can comprise more than a single line of contact along the rail. For example, the applicator bar 42' can be configured to contact the rail head along two or more parallel lines of contact.

As best illustrated in FIGS. 12 and 14, the applicator bar 42' has a plurality of orifices 44', and each of these orifices has an outlet 52' which opens primarily at the top surface 56' of the applicator bar. In one embodiment, the outlet 52' also opens at the upper margin of the inboard face 58' of the applicator bar 42'. Desirably, the entire outlet 52' is located above the elevation of the hard seal 205 to inhibit leakage below the hard seal. Further, when the applicator bar 42' is in its working position (FIG. 14), the inboard portion of the top surface 56' of the bar slopes down toward the inboard face 58' of the bar to assist in the collection, capture or pooling of friction modifying material in the space defined above the hard seal 205 by the applicator bar 42' and rail head 18. Over time, at least some of this pooled material tends to dry, thereby enhancing the hard seal 205 by filling in any small gaps between the rail head and applicator bar, such as gaps due to irregularities in the components. As viewed in FIG. 14, the outboard portion 209 of the top surface of the bar is chamfered at an angle A (e.g., about 15 degrees) to slope down toward the outboard face 50' of the bar 42' to increase the distance between this portion of the bar and a wheel 16 of a train passing over the bar.

Figure 15:
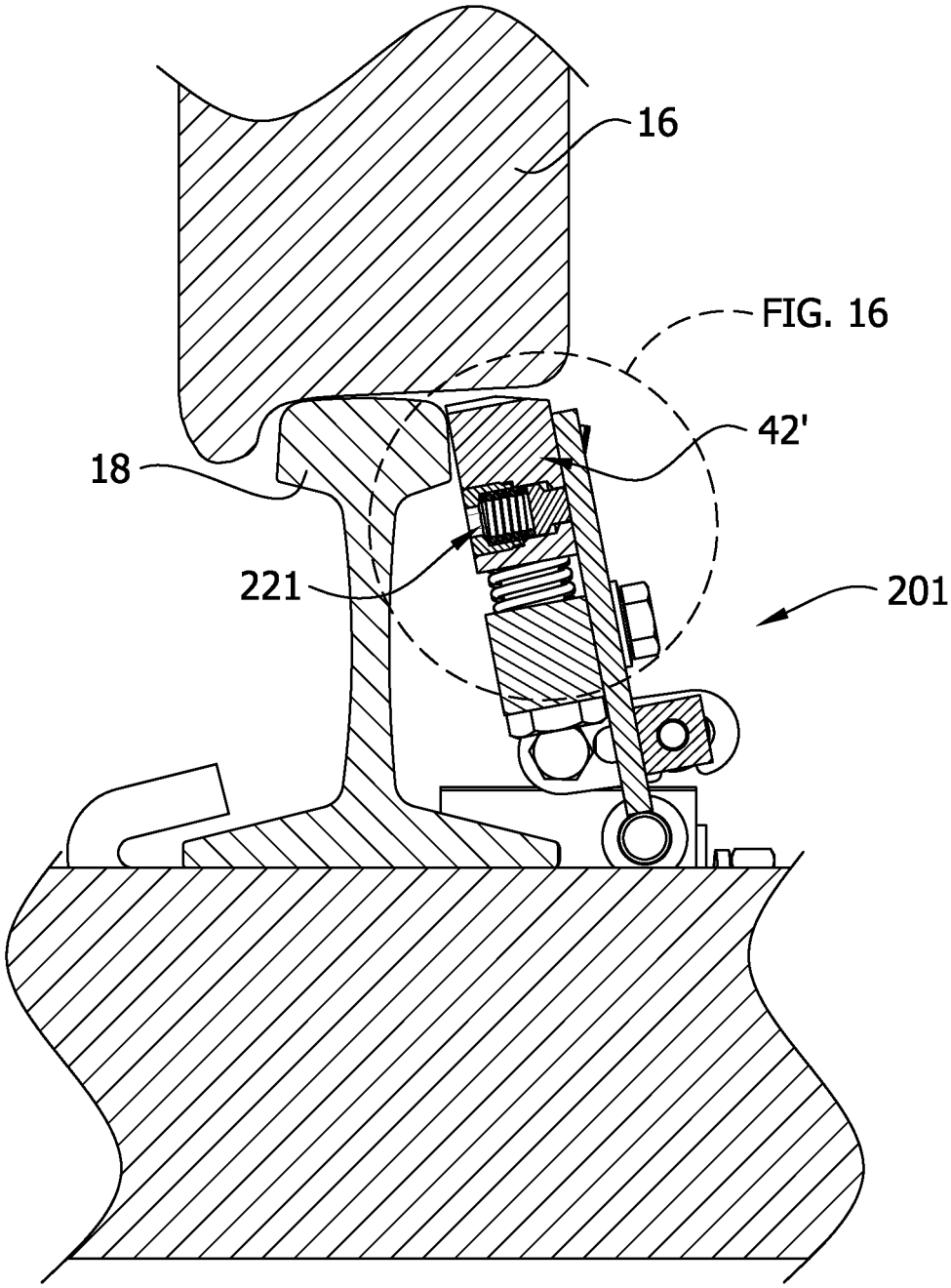
FIG. 15 is a vertical section through the applicator assembly showing a spring mechanism for urging the applicator bar against the rail head to help maintain the hard seal.
Figure 16:
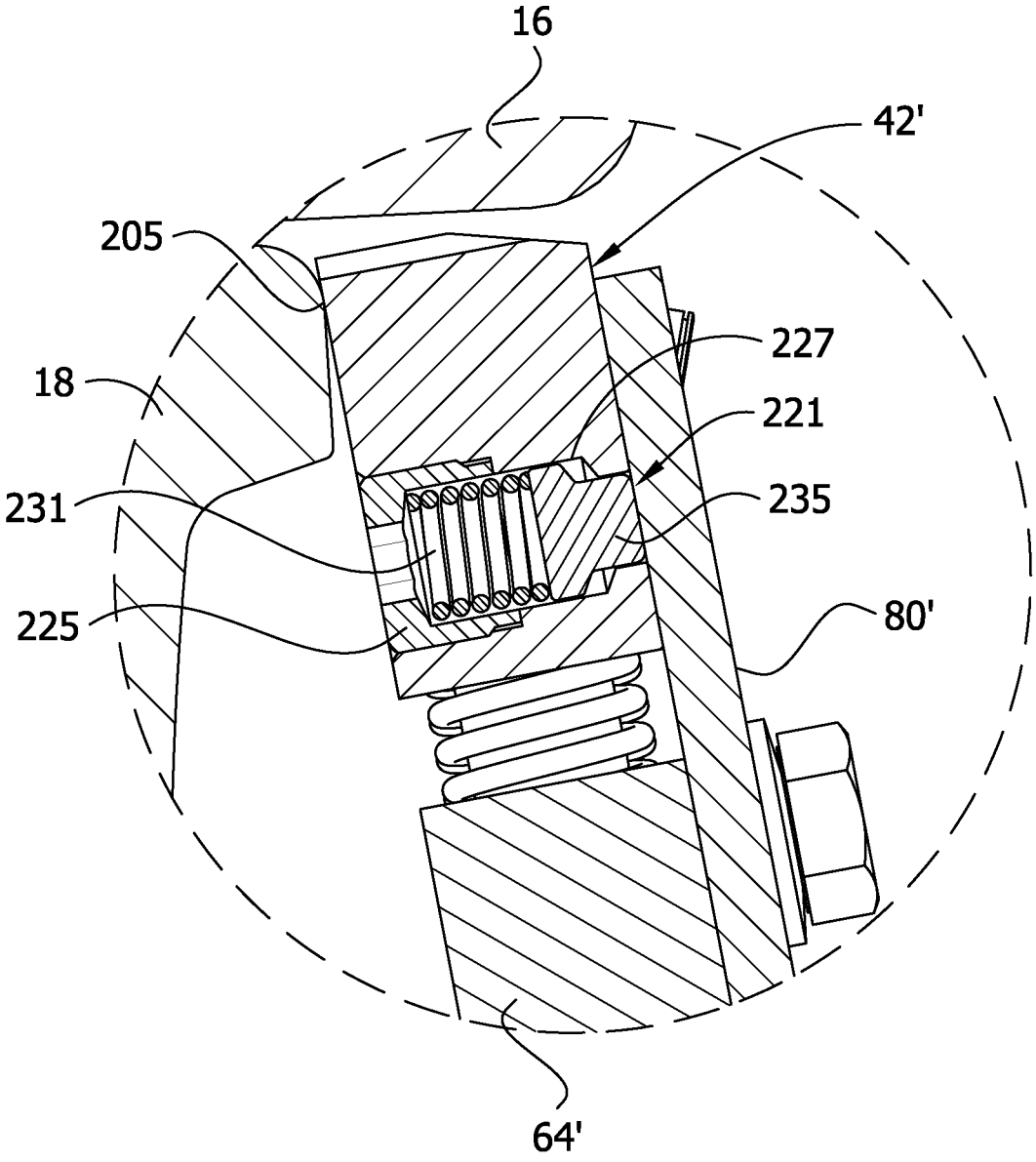
FIG. 16 is an enlarged portion of FIG. 15 showing details of the spring mechanism of FIG. 15.
Figure 17:
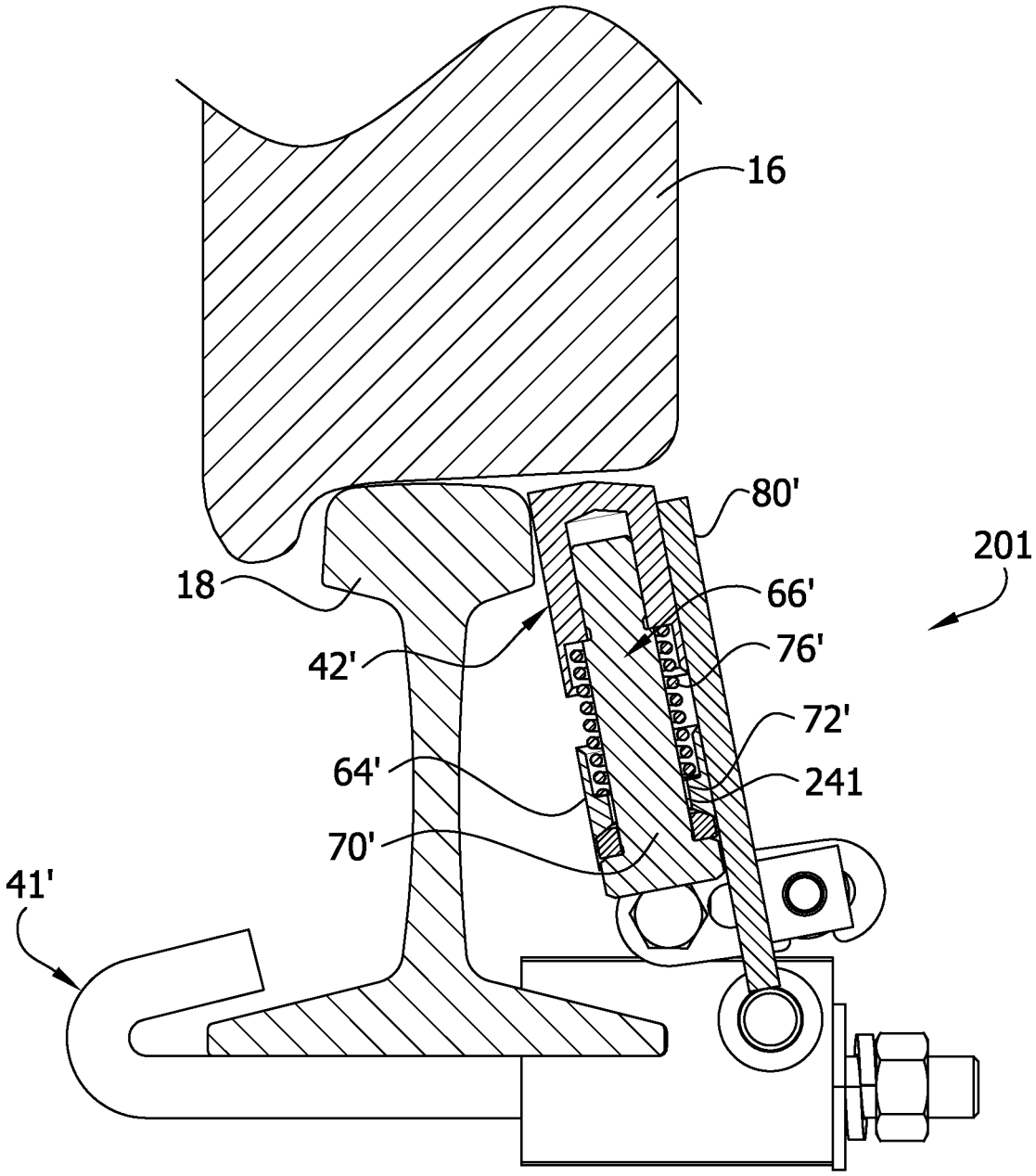
FIG. 17 is a vertical section through the applicator assembly of FIG. 12 showing details of how the applicator bar is mounted on a base of the assembly.

Referring to FIG. 13, as the applicator bar 42' is pivoted about the pivot axis 211 from its rail-service position to its working position it pivots past a vertical plane 215 through the pivot axis and comes to rest in a position where the inboard face 58' of the bar rests against the rail head 18 to form the hard seal 205 discussed above. Given the over-center position of the applicator bar 42', the weight of the bar tends to hold bar against the rail head to maintain the seal. Two spring mechanisms, each generally designated 221 in FIGS. 15 and 16, are provided generally adjacent opposite ends of the applicator bar 42' for urging the applicator bar toward the rail head to further assist in maintaining the hard seal 205. The number of spring mechanisms 221 can vary from one to two or more.

Referring to FIG. 16, the spring mechanisms 221 are mounted on the applicator bar 42' in a position between the bar and the mounting plate 80' (broadly referred to as a mount). Each spring mechanism 221 comprises a cup-shaped spring seat 225 threaded in a bore 227 in the bar 42' and a coil spring 231 in the bore. One end of the spring 231 is seated in the spring seat 225 and its other end is attached to a slider member 235. The spring urges the slider member 235 against the mounting plate 80' for sliding contact with the mounting plate 80' as the applicator bar 42' moves up and down between its raised and depressed positions. The slider member 235 is of a wear-resistant material such as ultra-high molecular weight polyethylene. When the applicator bar 42' is locked in its working position (e.g., by tightening the locking members 134 extending through the latching bars 118 described above), the coil spring 231 of each spring mechanism 221 is compressed and exerts a force tending to push the applicator bar away from the mounting plate 80' and against the rail head 18 to help maintain the hard seal 205 against the rail head 18 along the length of the applicator bar. It will be noted in this regard that the various component clearances are sufficient to allow limited movement of the applicator bar 42' toward and away from the mounting plate 80'. For example, referring to FIG. 17, the bores 72' in the base 64' of the applicator assembly may be sized to provide a clearance 241 between the unthreaded portion of the bolt shank 70' and the base sufficient to allow such limited movement (e.g., about 0.060 in.). As a result, the spring mechanisms 221 will hold the applicator bar 42' tightly against the rail head 18 to maintain the hard seal 205, at least within the range of movement provided by the aforementioned clearances. Other spring mechanisms may be used for this purpose. Further, such spring mechanism (s) may be mounted on the mounting plate 80' instead of the applicator bar 42'.

In use, the applicator assembly of apparatus 201 is secured to a rail by the securing device 41' previously described, or some other suitable securing device. The mounting plate 80' and applicator bar 42' are then pivoted to the working position shown in FIGS. 13 and 14 in which the applicator bar contacts the rail head 18 to make the hard seal 205. The applicator bar 42' is locked in this position, as described previously with respect to the first embodiment. The spring mechanisms 221 urge the bar 42' against the rail head 18 to maintain the hard seal 205 over time when gaps might otherwise form between the bar and the rail due to vibration, loosening of parts, wear, etc. In the event a wheel 16 of a train contacts the applicator bar 42', the bar will move down against the bias of the springs 76' from a raised position to a depressed position to avoid damage to the bar, as described earlier. When the wheel moves out of contact with the bar 42', the bar returns to its raised position. During this movement of the bar 42' between its raised and depressed positions, the slide members 235 of the spring assemblies 221 slide on the mounting plate and continue to urge the applicator bar against the rail head 18 to maintain the hard seal. (In effect, the hard seal 205 moves up and down on the rail head 18 as the applicator bar 42' moves between its raised and depressed positions.) As a result, leakage of friction modifying material down from the top of the rail is inhibited.

It will observed from the foregoing that the apparatus described above provides friction modifying material to the top of a rail head in a manner which is both efficient and economical. Further, the apparatus is designed to prevent or inhibit leakage of the friction modifying material down from the rail head without the use of soft seals. That is, the applicator assembly is free of any non-metal seals for sealing against such leakage. By way of example, the only seal used in the apparatus 201 for sealing against such leakage is the hard seal 205. As a result, maintenance time and costs are reduced.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. Apparatus for delivering a pumpable material to a top surface of a rail head of a metal rail, said apparatus comprising:

an applicator assembly and a securing device for securing the applicator assembly to said rail;

said applicator assembly comprising an applicator body having a plurality of orifices for delivery of said pumpable material to the top surface of the rail head, said body being resiliently yieldable against the urging of a first spring mechanism to permit the applicator body to move from a raised position, in which the orifices are positioned for delivering said pumpable material to the top surface of the rail head, to a depressed position in the event the applicator is contacted by a train wheel, the applicator body thereafter being adapted to return to said raised position;

said applicator assembly further comprising a mount mounting the applicator body for movement between a working position in which the applicator body is closely adjacent the rail head and a rail-service position in which the applicator body is remote from the rail head; and said applicator assembly and securing device being configured such that when the applicator body is in its working position, a metal portion of the applicator body contacts the rail head to form a metal-on-metal hard seal extending lengthwise of the rail head for inhibiting leakage of said pumpable material from the top of the rail head, said applicator assembly being free of any non-metal seals for sealing against said leakage, and wherein said applicator assembly further comprises a second spring mechanism for urging the applicator body against the rail head to help maintain said hard seal.

2. Apparatus as set forth in claim 1 wherein said metal portion of the applicator body which contacts the rail head to form said hard seal comprises an inboard face of the applicator body, and wherein said second spring mechanism exerts a spring force generally perpendicular to said inboard face.

3. Apparatus as set in claim 2 wherein said second spring mechanism comprises at least one spring interposed between said mount and said applicator body.

4. Apparatus as set forth in claim 2 wherein said second spring mechanism is carried by one of said mount and applicator body and comprises a slide member adapted for sliding contact with the other of said mount and applicator body as the applicator body moves between its raised and depressed positions.

5. Apparatus as set forth in claim 1 wherein each orifice of the plurality of orifices has an inlet and an outlet, and wherein said applicator body is configured such that the entire outlet is located above said hard seal when the applicator body is in its working position.

6. Apparatus as set forth in claim 5 wherein said orifice outlet exits the applicator body at a top surface of the applicator body.

7. Apparatus as set forth in claim 6 wherein said metal portion of the body which contacts the rail to form said hard seal comprises an inboard face of the applicator body, and wherein said orifice outlet exits the applicator body at said top surface and said inboard face.

8. Apparatus as set forth in claim 6 wherein said top surface of the applicator body slopes down toward the rail head when the applicator body is in its working position.

9. Apparatus as set forth in claim 5 wherein said applicator body is mounted for pivotal movement about a pivot axis between said rail-service and working positions, and wherein said applicator body pivots past a vertical plane through said pivot axis as it pivots toward its working position.

10. Apparatus as set forth in claim 1 wherein said first spring mechanism comprises a spring resiliently urging the applicator body toward said raised position, the spring being resiliently yieldable to permit the applicator body to move to the depressed position in the event the applicator is contacted by a train wheel, the applicator body thereafter being adapted to return to said raised position under the bias of the spring, said applicator body remaining in contact with said rail head during movement of the applicator body between said raised and depressed positions to maintain said hard seal.

11. Apparatus as set forth in claim 10 wherein said applicator assembly further comprises a base and a guide connecting the base and the applicator bar for guiding the applicator bar between said raised and depressed positions.

12. Apparatus as set forth in claim 1 wherein said securing device comprises a clamp for clamping the applicator assembly to a lower flange of the rail.

13. An applicator assembly for delivering a pumpable material to a top surface of a rail head of a metal rail, said assembly comprising:

an applicator body having a plurality of orifices for delivery of said pumpable material to the top surface of the rail head;

a mount mounting the applicator body for movement between a working position in which the applicator body is closely adjacent the rail head and a rail-service position in which the applicator body is remote from the rail head;

said applicator body being configured such that when the applicator body is in its working position, a metal portion of the body contacts the rail head to form a metal-on-metal hard seal extending lengthwise of the rail head for inhibiting leakage of said pumpable material from the top of the rail head;

a spring mechanism for urging the applicator body against the rail head to help maintain said hard seal; and wherein said applicator body and mount are free of any non-metal seals for sealing against said leakage.

14. An applicator assembly as set forth in claim 13 wherein said metal portion of the applicator body which contacts the rail head to form said hard seal comprises an inboard face of the applicator body, and wherein said spring mechanism exerts a spring force generally perpendicular to said inboard face.

15. An applicator assembly as set in claim 14 wherein said spring mechanism comprises a spring interposed between said mount and said applicator body.

16. An applicator assembly as set forth in claim 14 wherein said spring mechanism is carried by one of said mount and applicator body and comprises a slide member adapted for sliding contact with the other of said mount and applicator body as the applicator body moves between raised and depressed positions.

17. An applicator assembly as set forth in claim 13 wherein each orifice of the plurality of orifices has an inlet and an outlet, and wherein said applicator body is configured such that the entire outlet is located above said hard seal when the applicator body is in its working position.

18. An applicator assembly as set forth in claim 17 wherein said orifice outlet exits the applicator body at a top surface of the applicator body.

19. An applicator assembly as set forth in claim 17 wherein said metal portion of the body which contacts the rail to form said hard seal comprises an inboard face of the applicator body, and wherein said orifice outlet exits the applicator body at said top surface and said inboard face.

20. An applicator assembly as set forth in claim 18 wherein said top surface of the applicator body slopes down toward the rail head when the applicator body is in its working position.

21. Apparatus for delivering a friction modifying material to a top surface of a rail head of a metal rail, said apparatus comprising:

an applicator assembly comprising an applicator body having a plurality of orifices for delivery of said friction modifying material to the top surface of the rail head;

a securing device for securing the applicator assembly to said rail;

said applicator assembly being configured such that when the applicator body is in a working position for delivering the friction modifying material to the top surface of the rail, a metal portion of the applicator body contacts the rail head to form a metal-on-metal hard seal extending lengthwise of the rail head for inhibiting leakage of said friction modifying material from the top of the rail head, said applicator assembly being free of any non-metal seals for sealing against said leakage, wherein said applicator assembly further comprises a spring mechanism for urging the applicator body against the rail head to help maintain said hard seal, wherein each orifice of the plurality of orifices has an inlet and an outlet, and wherein said applicator body is configured such that the entire outlet is located above said hard seal when the applicator body is in said working position, and wherein said orifice outlet exits the applicator body at a top surface of the applicator body.

22. Apparatus for delivering a fiction modifying material to a top surface of a rail head of a metal rail, said apparatus comprising:

an applicator assembly comprising an applicator body having a plurality if orifices for delivery of said friction modifying material to the top surface of the rail head;

a securing device for securing the applicator to said rail;

said applicator assembly being configured such that when the applicator body is in a working position for delivering the friction modifying material to the top surface of the rail, a metal portion of the applicator body contacts the rail head to form a metal-on-metal hard seal extending lenghthwise of the rail head for inhibiting leakage of said friction modifying material from the top of the rail head, said applicator assembly being free of any non-metal seals for sealing against said leakage, wherein said applicator assembly further comprises a spring mechanism for urging the applicator body against the rail head to help maintain said hard seal, wherein each orifice of the plurality of orifices has an inlet and an outlet, and wherein said applicator body is configured such that the entire outlet is located above said hard seal when the applicator body is in said working position, wherein said applicator body comprises a monolithic metal bar, and wherein said metal portion of the applicator body comprises an upright inboard face of the metal bar facing said rail head when the applicator body is in said working position.

23. Apparatus as set forth in claim 22 wherein said spring mechanism exerts a spring force generally perpendicular to said inboard face.

24. A method of installing apparatus for delivering a friction modifying material to a top surface of a rail head of a metal rail, said method comprising:

securing an applicator assembly to the rail, said applicator assembly comprising an applicator body having a plurality of orifices for delivery of said friction modifying material to the top surface of the rail head; and pivoting the applicator body from a rail-service position in which the applicator body is remote from the rail head into a working position in which a portion of the metal body is in contact with the rail head to form a metal-on-metal hard seal extending lengthwise of the rail head for inhibiting leakage of said friction modifying material from the top of the rail head, said applicator assembly being free of any non-metal seals for sealing against said leakage.

25. A method as set forth in claim 24 further comprising locking said applicator body in said working position.

26. A method as set forth in claim 25 further comprising resiliently urging said portion of the metal body against the rail head to help maintain said hard seal.

* * * * *